United States Patent [19]

Yamashita et al.

[11] Patent Number: 4,981,293

[45] Date of Patent: Jan. 1, 1991

[54] SHEET STORING APPARATUS PROVIDED FOR A COPYING MACHINE

[75] Inventors: Hiroki Yamashita; Keichi Kinoshita; Toshio Matsui; Wataru Kurahashi; Katsuya Yasuda, all of Osaka, Japan

[73] Assignee: Minolta Camera Kabushiki Kaisha, Osaka, Japan

[21] Appl. No.: 311,065

[22] Filed: Feb. 16, 1989

[30] Foreign Application Priority Data

| | | | |
|---|---|---|---|
| Feb. 18, 1988 | [JP] | Japan | 63-35895 |
| Feb. 18, 1988 | [JP] | Japan | 63-35897 |
| May 21, 1988 | [JP] | Japan | 63-124666 |
| May 21, 1988 | [JP] | Japan | 63-124667 |
| May 21, 1988 | [JP] | Japan | 63-124668 |

[51] Int. Cl.[5] ..... B65H 29/22

[52] U.S. Cl. ..... 271/184; 271/213; 414/791.2

[58] Field of Search ..... 271/184, 207, 212, 213; 414/791.2

[56] References Cited

U.S. PATENT DOCUMENTS

| | | | |
|---|---|---|---|
| 3,709,595 | 1/1973 | Turner et al. . | |
| 3,833,911 | 9/1974 | Caldwell et al. . | |
| 3,845,949 | 11/1974 | Acquaviva et al. . | |
| 4,091,978 | 5/1978 | Graham | 271/184 X |
| 4,125,255 | 11/1978 | Stovall | 271/274 |
| 4,229,650 | 10/1980 | Takahashi et al. . | |
| 4,318,539 | 3/1982 | Lamos . | |
| 4,480,825 | 11/1984 | Landa | 271/184 X |
| 4,548,402 | 10/1985 | Namba . | |
| 4,629,173 | 12/1986 | Hashimoto et al. . | |
| 4,635,920 | 1/1987 | Kodama . | |
| 4,669,717 | 6/1987 | Yamashita et al. . | |
| 4,718,657 | 1/1988 | Otter et al. . | |
| 4,718,658 | 1/1988 | Hirose et al. . | |
| 4,726,579 | 2/1988 | Kiba et al. . | |
| 4,801,133 | 1/1989 | Ishiguro et al. . | |
| 4,811,048 | 3/1989 | Ishikawa et al. . | |
| 4,852,867 | 8/1989 | Johdai et al. . | |
| 4,864,350 | 9/1989 | Ishiguro et al. . | |
| 4,886,259 | 12/1989 | Ishikawa et al. . | |
| 4,901,994 | 2/1990 | Ishiguro et al. . | |

FOREIGN PATENT DOCUMENTS 59-203054 11/1984 Japan .

OTHER PUBLICATIONS

IBM Technical Disclosure Bulletin, "Sheet Stacking Technique", vol. 17, No. 8.

*Primary Examiner*—Richard A. Schacher

*Attorney, Agent, or Firm*—Burns, Doane, Swecker & Mathis

[57] ABSTRACT

A sheet storing apparatus comprising a tray for receiving sheets ejected from a copying machine, a first shift unit for reciprocating the tray in the direction perpendicular to the ejection of sheets, an aligning member for aligning the sheets on the tray, which is in contact with the surface of the top of the sheets on the tray and a second shift unit for shiting the aligning member in the same direction as that of the shifting of the tray. The sheets are divided by the shifting of the tray every time a set of sheets finishes to be transported onto the tray, and the aligning member is shifted synchronized with the shifting of the tray. Further, the sheet storing apparatus is provided with a rotatable ejection roller for transporting sheets onto the tray and a round transport member which is in contact with the ejection roller and rotatable together with the rotation of the ejection roller, and through between which and the ejection roller and sheets are transported onto the tray, and the ejection roller is shifted in the direction perpendicular to the ejection of sheets synchronized with the shifting of the tray.

8 Claims, 24 Drawing Sheets

S7
Paper feed determining

S701
Copy inhibition F=0 ?
NO
YES
S706
Over-stack F =0 ?
NO
YES
S707
Copy inhibition F ← 0
S702
SW301 on-edge ?
NO
YES
S708
Print F =1 ?
NO
YES
S703
Print F ← 1
S709
Shift F =0 ?
NO
YES
S704
RDH signal =1 ?
NO
YES
S705
Paper feed F ← 1
S710
Paper feed F =1 ?
NO
YES
S711
RDH signal =1 ?
YES
NO
S712
Document feed signal=0 ?
NO
YES
S713
Document feed signal ← 1
S714
Document set signal=1 ?
NO
YES
S715
Paper feed F ← 1
Document set signal ← 0
B
A
B

SHEET STORING APPARATUS PROVIDED FOR A COPYING MACHINE

FIELD OF THE INVENTION

The present invention relates to a sheet storing apparatus, particularly, a sheet storing apparatus where sheets ejected from an image forming apparatus such as a copying machine are stored on a tray.

BACKGROUND OF THE INVENTION

Sheets ejected from an image forming apparatus such as a copying machine, a laser beam printer or the like sometimes need to be divided into sets so that each set may comprise a specified number of sheets. Various types of sheet storing apparatus for dividing a number of printed sheets into sets by shifting operation in the direction perpendicular to the ejection of sheets have been commercialized. Two ways of shifting operation for the sheets have been developed, one of them being that a tray is reciprocated and the other being that a pair of ejection rollers for transporting sheets onto the tray is reciprocated (Refer to U.S Pat. No. 4,635,920).

However, in a conventional sheet storing apparatus, sheets stored on a tray are left alone without any means of aligning. Here is a problem that the sheets divided into sets by the shifting operation may be pushed by the next coming sheets and may be put out of alignment. Also, the shifting of the pair of ejection rollers may cause the complication of the constitution, and there is a problem that the pressure of the pair of ejection rollers is apt to be ill balanced, so that the transport force on sheets may be scattered.

SUMMARY OF THE INVENTION

In view of the above-mentioned problems, an object of the present invention is to provide a sheet storing apparatus wherein the alignment of the sheets stacked and stored on a tray are surely performed, and also the aligned sheets do not get back out of alignment by the shifting operation.

The other object of the present invention is to provide a sheet storing apparatus wherein the shifting operation for the division of sheets can be performed with simple constitution, and the transport force of ejection rollers is not be scattered.

To attain the above-mentioned objects, a sheet storing apparatus according to the present invention comprises a tray for receiving sheets ejected from an image forming apparatus; first shift means for reciprocating the tray in the direction perpendicular to the ejection of sheets; an aligning member for aligning the sheets on the tray; second shift means for shifting the aligning member synchronized with the shifting of the tray by the first shift means The sheets ejected from the image forming apparatus are stacked and stored on the tray, and the trailing edges of the sheets are given the force by the aligning member, for example, the force in the direction reverse to the ejection of sheets by the rotation of the aligning member, so that the sheets are aligned with their trailing edges regulated with a back plate. This aligning member is always in contact with the surface of the top of the sheets on the tray to keep the sheets in alignment. On the other hand, each time a specified number of sheets finishes to be transported onto the tray, the tray is shifted in the direction perpendicular to the ejection of sheets by the shift means to divide the sheets. At this moment, the aligning member is shifted synchronized with the shifting of the tray. That is, the aligning member is shifted synchronized with the shifting of the tray and the already aligned sheets thereon, so that the sheets are not put out of alignment. A sheet storing apparatus according to the present invention, preferably, is arranged so that the rotation of the aligning means is stopped during the shifting operation, and the arrangement can prevent trouble that the top of the sheets on the tray which the aligning means touches is burdened unnecessarily during the shifting operation.

Further, a sheet storing apparatus according to the present invention has a rotatable ejection roller for transporting sheets to the tray and a round transport member which is in contact with the ejection roller and rotatable together with the rotation of the ejection roller, and the ejection roller can be shifted synchronized with the shifting of the tray. The sheets are transported onto the tray by the rotation of the ejection roller and the accompanying rotation of the round transport member. Also, the round transport member rotates at a fixed position accompanying the shifting of the tray as well as the rotation of the ejection roller. Thus, since the rotating transport member to be engaged with the ejection roller is shaped into a ball, the transport member can be rotated accompanying the rotation of the ejection roller and the shifting of the tray, so that special means for shifting the round transport member need not be provided. Preferably, if the round transport member is in contact with the ejection roller by its own weight, the pressure of the round transport member on the ejection roller is fixed, so that the transport force on sheets may not be scattered.

BRIEF DESCRIPTION OF THE DRAWINGS

These and other objects and features of the present invention will become apparent from the following description taken in conjunction with the preferred embodiment thereof with reference to the accompanying drawings, in which.

the drawings show an embodiment of a sheet storing apparatus according to the present invention.

DETAILED DESCRIPTION OF THE EMBODIMENT

An embodiment of a sheet storing apparatus according to the present invention is described below referring to the accompanying drawings.

(General constitution including the copying machine)

Figure 1:
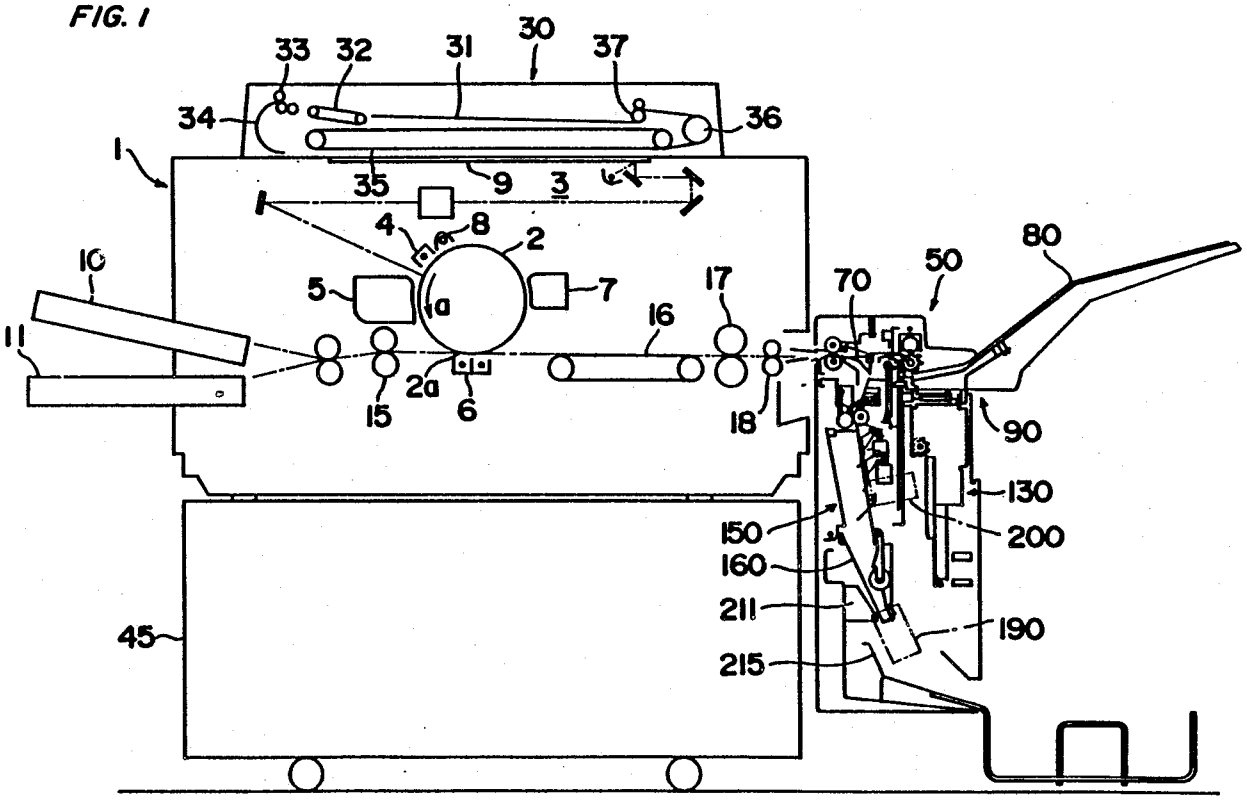
FIG. 1 is a schematic block diagram including a copying machine.

First, the general constitution including a copying machine 1 is described referring to FIG. 1.

The copying machine 1 is placed on a desk 45, and a recirculating document handling device 30 (which is hereinafter abbreviated to RDH) is disposed on the upper surface thereof. In the center of the copying machine 1, a photosensitive drum 2 is disposed. Around the drum 2, elements for image forming such as an optical system 3, an electrifying charger 4, a developing device 5, a transfer charger 6, a cleaning device 7, an eraser lamp 8 and so on are arranged. These elements and the operation system of the elements are so well-known that the detailed description of them is omitted.

Copying paper which is loaded in automatic paper feeder cassettes 10 and 11 is fed sheet by sheet selectively from the cassette 10 or 11. A sheet of copying paper is transported to a transfer portion 2*a* by a pair of timing rollers 15, synchronized with a toner image on the circumferential surface of the photosensitive drum 2. After the transfer processing, the sheet is supplied to a fixing device 17, where the toner image is fixed on the sheet, by a conveyor belt 16, and then the sheet is ejected therefrom by a pair of ejection rollers 18. At that time, the sheet is detected by a sensor SE1 disposed immediately before the ejection rollers 18.

The RDH 30 generally comprises a document tray 31, a document feed belt 32, a pair of document feed rollers 33, a diverting guide plate 34, a transport belt 35, a diverting roller 36 and a pair of ejection rollers 37. The RDH 30 transports a set of documents one by one in order of page starting with the last page. A set of documents should be placed on the tray 31 with the last page faced down at the bottom, so that the documents are drawn out one by one in order from the last page by the rotation of the document feed belt 32 and fed between the transport belt 35 and a document deck glass 9 through the pair of document feed rollers 33 and the diverting guide plate 34. Next, the document is set at a specified position on the document glass 9 by the travel of the transport belt 35 to be exposed by the conventional optical system 3. After the image exposure, the document is transported by the transport belt 35 from the document deck glass 9 toward the right side in FIG. 1, where the document is diverted by the diverting roller 36, and ejected by the pair of ejection rollers 37 onto a stack of documents on the tray 31 with the surface having an image upward.

Incidentally, one cycle of copying operation is defined as one sequence of image exposure that all the documents placed on the tray 31 are once exposed. The number of documents and the number of copy sets to be made can be inputted with input means (ten-key) on an operation panel as described later. Each time one cycle of copying operation for one set of documents is completed, an ejection tray 80 is shifted as described later, or the documents are circularly transported as described above to repeat cycles of copying operation up to the number of copy sets inputted with the input means while the copying operation is discontinued to execute a stapling operation and a stamping operation, corresponding to the operation mode of a finisher unit 50.

A sheet storing apparatus, in this embodiment, corresponds to the finisher unit 50 wherein sheets ejected from the copying machine 1 are selectively stacked on the ejection tray 80 or stored in a stapling tray 150 to be aligned and stapled by a stapler 190. Accordingly, in the case of making a plurality of copy sets processed by the stapling operation and the stamping operation with use of the RDH 30, one set of copying paper is stored in the stapling tray 150 at the time of the output of a one cycle completion signal, and after the alignment of the last sheet, the stapler 190 and the stamp 200 are operated to staple and stamp the copy set. The stapled set is stacked and stored in a stack box 220.

(Constitution of the finisher unit)

Figure 2:
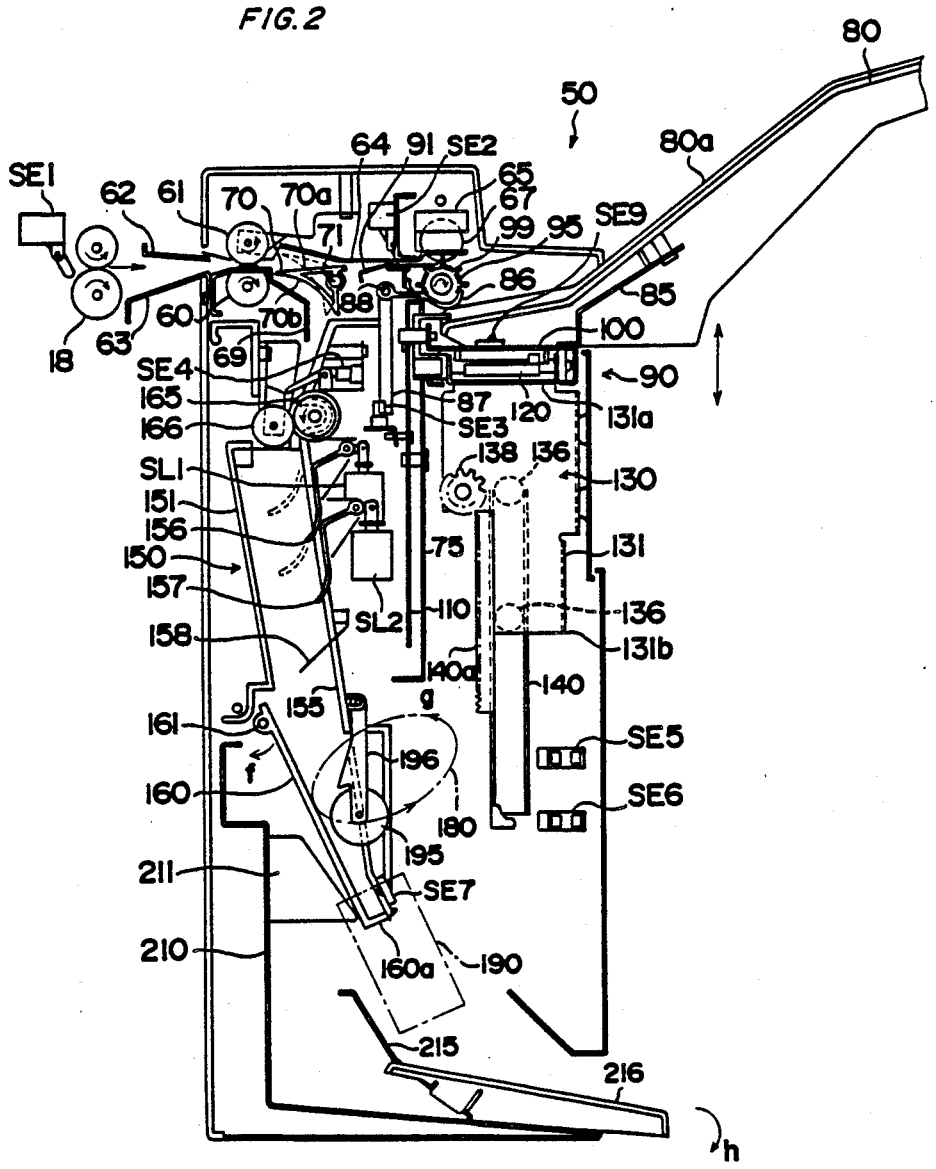
FIG. 2 is an internal construction showing a finisher unit.
Figure 11:
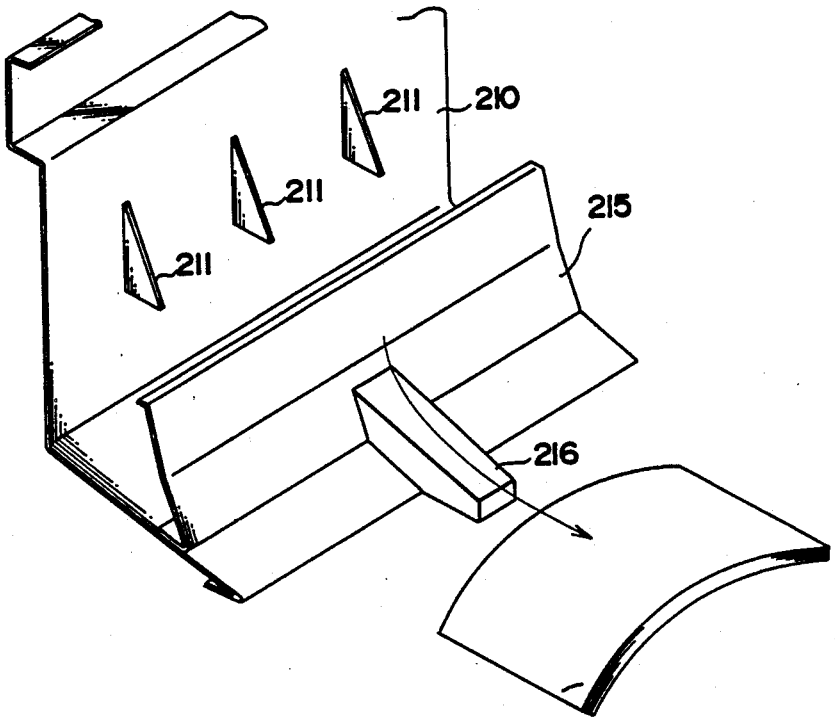
FIG. 11 is a perspective view showing a sheet ejection portion of the stapling tray.

Next, the constitution of the finisher unit 50 is herewith described referring to FIGS. 2 and 11.

This finisher unit 50 is generally composed of rollers 60 and 61 for receiving copying paper, a diverting member 70 for diverting the transport pass, an ejection tray 80, a shift block 90 for shifting the ejection tray 80 in the direction crossing the direction of the sheet ejection at a right angle each time one set of copying paper corresponding to a set of documents is stacked thereon, an elevate block 130 for lifting down the ejection tray 80 at intervals to keep the falling rate of sheets of copying paper down onto the ejection tray 80, and the stapling tray 150 having a stapling function and a stamping function.

The portion where copying paper is received is provided with guide plates 62 and 63 opposed to the pair of ejection rollers 18 as well as the driving roller 60, the accompanying roller 61. In the finisher unit 50, further, the diverting member 70, guide plates 64, 69 and 91 a sensor SE2 for detecting copying paper being ejected onto the ejection tray 80 are set.

The bill-shaped diverting member 70 is disposed so as to pivot on a shaft 71, and the diverting member 70 shifts its position from that shown by a solid line to that shown by a dashed line in FIG. 2 when a solenoid not shown by the drawings is turned on. When the diverting member 70 is at the position shown by the solid line, its upper surface 70*a* guides copying paper to the ejection tray 80, and when it is shifted to the position sown by the dashed line, its curved surface 70*b* guides copying paper to the stapling tray 150.

Figure 3:
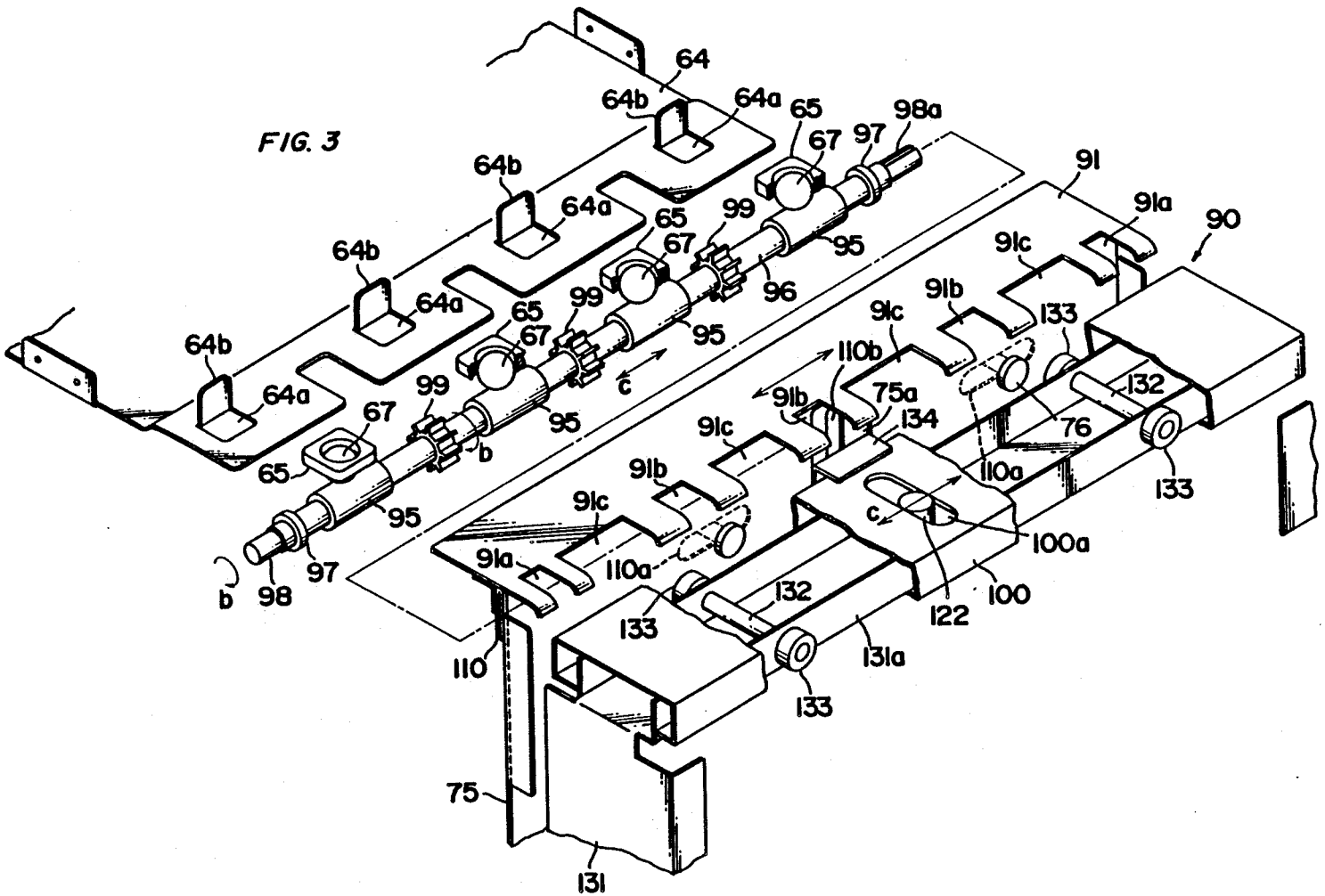
FIG. 3 is an exploded view in perspective showing ejection rollers and a shift block.
Figure 5:
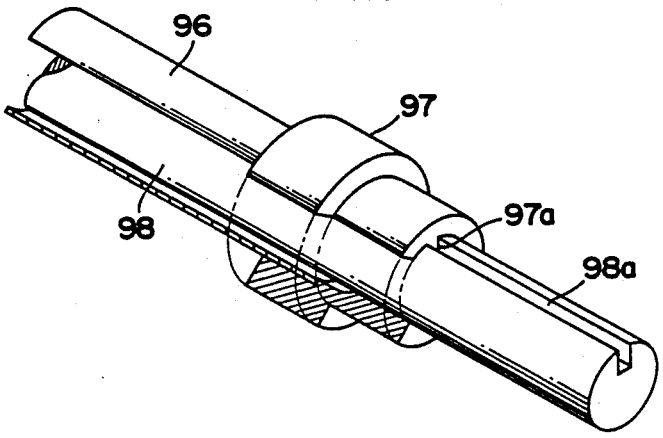
FIG. 5 is a perspective view showing a supporting mechanism for the ejection rollers and paddle wheels.

Copying paper is ejected onto the ejection tray 80, as shown in FIG. 3, by ejection rollers 95 and balls 67, and the ejected sheet is aligned by paddle wheels 99 which are disposed on the same shaft as the ejection rollers 95 are. The paddle wheels 99, which are equipped with radially-arranged flexible blades, provides the force in the direction reverse to that of the sheet ejection with the trailing edge of the sheet ejected onto the ejection tray 80 and presses the trailing edge of the sheet against a fixed back plate 75 to align the sheet In this embodiment, the ejection tray 80 is shifted at a specified timing to divide copying paper into sets. Accordingly, the paddle wheels 99 which always touch the trailing edge of a sheet need to be shifted synchronized with the shifting of the ejection tray 80 in order not to put the sheet out of alignment. So, the paddle wheels 99 and the ejection rollers 95 are constructed so as to be shifted in a body. That is, the paddle wheels 99 and the ejection rollers 95 are fixed to a cylindrical shaft 96, and the shaft 96 is loosely disposed to a shaft 98 which is rotatably disposed to a frame not shown in the drawings. The shaft 98 can rotate in the direction of arrow (b) by a transport motor not shown in the drawings, and a key way 98*a* formed on the shaft 98 is engaged with key 97*a* shown in FIG. 5 disposed on each of ring shaped stoppers 97 fixed to the both ends of the shaft 96. Accordingly, the paddle wheels 99 and the ejection rollers 95 are driven to rotate in the direction of arrow (b) in a body and can be shifted in the direction of arrow (c). The shifting of the paddle wheels 99 and the ejection rollers 95 follows that the stoppers 97 are engaged with notches 91*a* on the bottom guide plate 91 so that the bottom guide plate 91 is shifted in the direction of arrow (c) together with the shift block 90 as described later Also, the paddle wheels 99 and the ejection rollers 95 are positioned at notches 91*b* and 91*c* on the bottom guide plate 91 respectively.

Further, when the paddle wheels 99 are shifted accompanying the shifting of the ejection tray 80, they are stopped rotating. If the paddle wheels 99 are driven to rotate in the direction of arrow (b) at the time of shifting, the trailing edge of the top sheets of copying paper is pressed against the fixed back plate 75 by the force of the paddle wheels 99, and the sheet is left behind with the shifting. As a result, the sheets are put out of alignment. Consequently, the paddle wheels 99 are stopped rotating to prevent this trouble. The paddle wheels 99 are stopped rotating by the stoppage of rotation of the transport motor.

Figure 4:
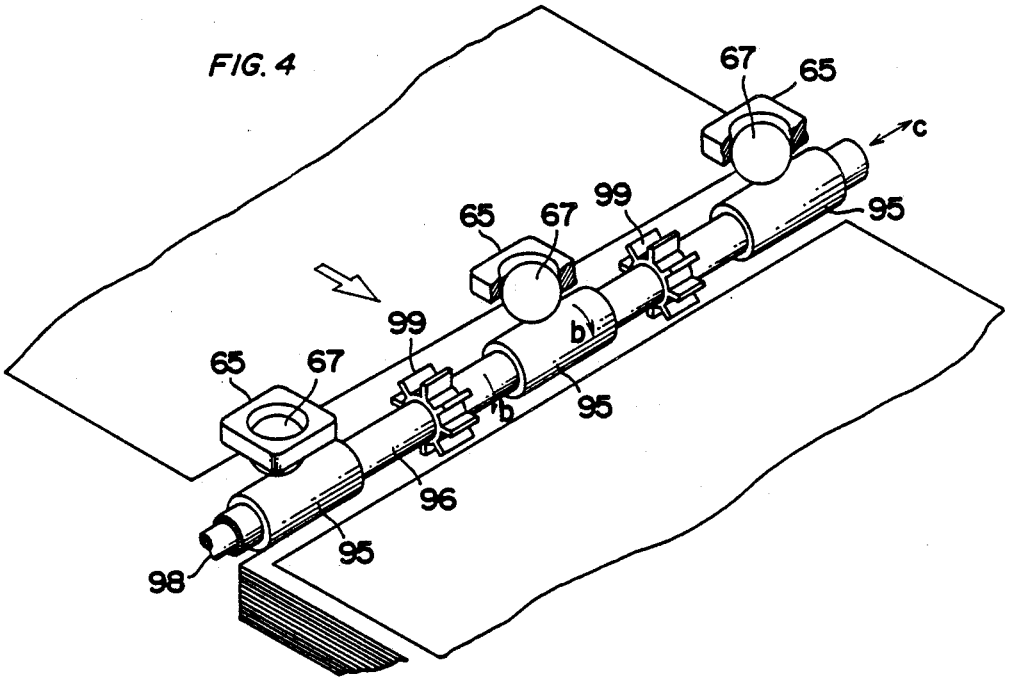
FIG. 4 is a perspective view showing sheet transport condition onto a ejection try.

On the other hand, the balls 67 which can rotate are pressed on the ejection rollers 95 by their own weight respectively. That is, as shown in FIGS. 3 and 4, the balls 67 are positioned at openings 64*a* formed on a top guide plate 64 respectively and are prevented from moving by holders 65 fixed on tabs 64*b* cut out at the openings 64*a*. The balls 67 can accompany the rotation and the shifting of the ejection rollers 95 within the holders 65 so as to nip a sheet of copying paper in cooperation with the ejection rollers 95 to feed the sheet onto the ejection tray 80.

As shown in FIG. 2, the ejection tray 80 has a plurality of linear protrusions 80*a* extending in the direction of the sheet ejection on its surface and mounted on a shift frame 100 by a supporting plate 85. The back end of the ejection tray 80 touches the top portion of the fixed back plate 75, and an actuator 86 for a sensor SE3 is disposed above it. The actuator 86 can pivot on a shaft 88 in a body together with a lever 87, the bottom portion of the lever 87 usually intercepts the optical axis from the sensor SE3. When the number of sheets stacked on the ejection tray 80 increases, so that the sheets push up the actuator 86, the lever 87 pivots counterclockwise in FIG. 2 on the shaft 88 together with the actuator 86 so that the optical axis from the sensor SE3 which has been intercepted by the bottom portion of the lever 87 penetrates. Thus, the level of the surface of the top sheet of copying paper is detected, and the elevate block 130 is operated as described later so as to move down the ejection tray 80.

(Shift block)

Figure 6:
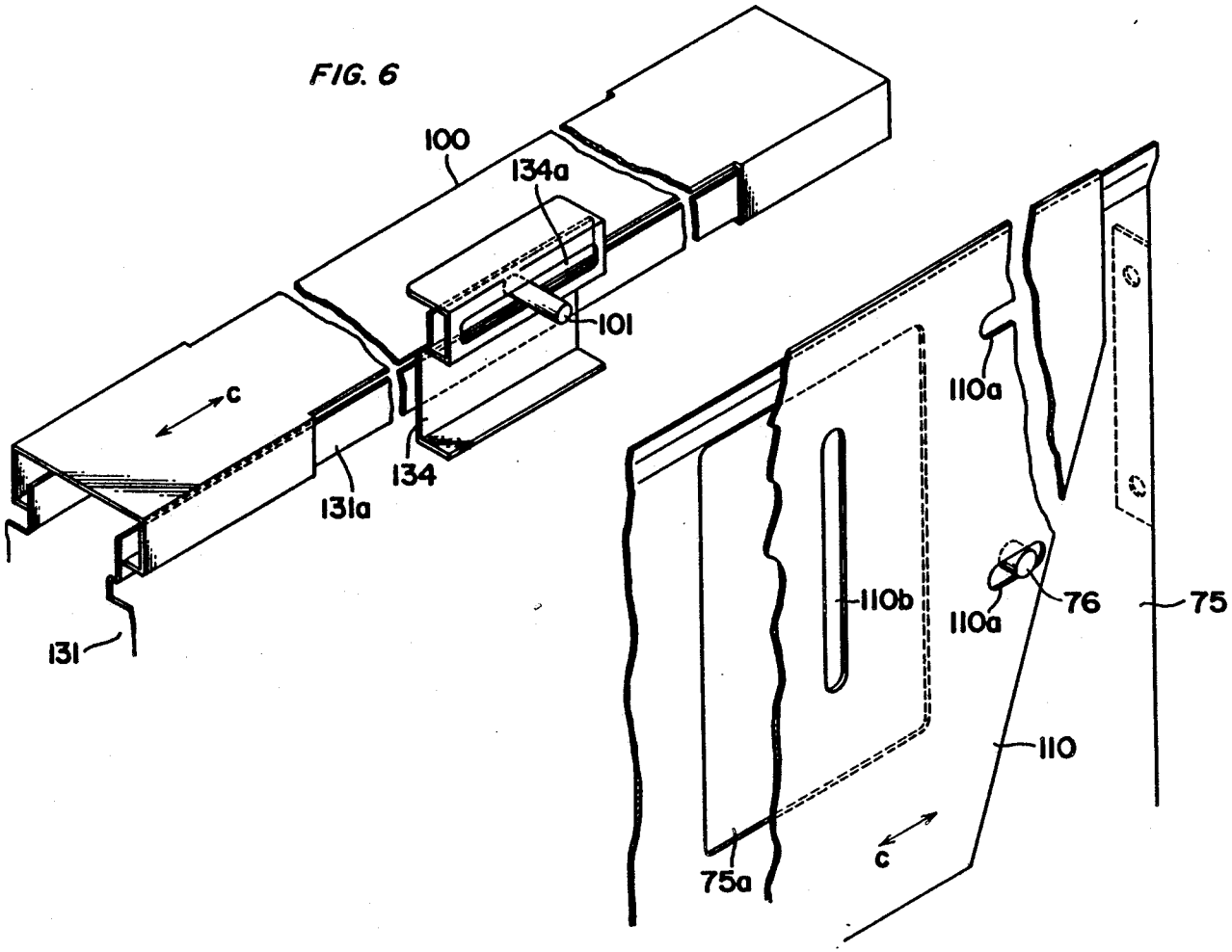
FIG. 6 is an exploded view in perspective showing the shift block.
Figure 8:
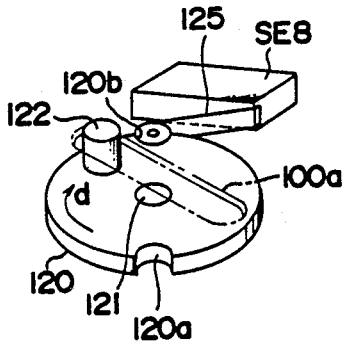
FIG. 8 is a perspective view showing a shift cam.

The shift frame 100 on which the ejection tray 80 is disposed, as shown in FIGS. 3 and 6, can be shifted in the direction of arrow (c) guided by guide rollers 133 which are rotatably provided with shafts 132 through a lateral guide portion 131*a* of an elevate frame 131. A cam 120 shown in FIG. 8 is set inside the lateral guide portion 131*a*, and a pin 122 fixed on an edge of the cam 120 is engaged with a long hole 100*a* on the shift frame 100. The cam 120 can be driven to pivot in the direction of arrow (d) on a shaft 121 by a shift motor not shown in the drawings, and recesses 120*a* and 120*b* which are located with the point symmetry at an angle of 180 degrees to each other are formed on the circumferential surface of the cam 120. Also, an actuator 125 for a sensor SE8 is arranged on the circumference of the cam 120 and the sensor SE8 works each time the actuator 125 falls down to the recess 120*a* or 120*b* during the rotation of the cam 120.

With the above-described arrangement, one cycle of copying operation with use of the RDH 30 is completed; the last sheet of a set of copying paper corresponding to a set of original documents is ejected onto the ejection tray 80; the shift motor is started to drive so that the cam 120 rotates in the direction of arrow (d); the actuator 125 falls down into the recess 120*a* or 120*b;* and then the shift motor is turned off. Thus and so, the cam 120 rotates at an angle of 180 degrees intermittently each time a specified number of sheets is fed onto the ejection tray 80, and the shift frame 100 repeats to be reciprocated via the pin 122 together with the ejection tray 80 in the direction of arrow (c), that is, in the direction of intersecting at a right angle with the direction of the sheet ejection.

Further, the fixed back plate 75 and a movable back plate 110 are mounted on the back side of the shift frame 100. The fixed back plate 75 is fixed to the main frame of the finisher unit 50, and it regulates the trailing edges of sheets transported onto the ejection tray 80. The movable back plate 110 functions to shift the ejection rollers 95, the sensor SE3 and the actuator 86 synchronized with the shifting of the ejection tray 80, and the bottom guide plate 91 is fixed to this movable back plate 110.

More specifically, as shown in FIGS. 3 and 6, three pins 76 disposed on the fixed back plate 75 engage with long holes 110*a* formed on the movable back plate 110 so that the movable back plate 110 can be shifted in the direction of arrow (c). Also, a pin 101 disposed on the shift frame 100 engages with a long hole 110*b* vertically formed on the movable back plate 110 through a long hole 134*a* on a guide plate 134 fixed to the lateral guide portion 131*a* of the elevate frame 131 and an opening 75*a* on the fixed back plate 75. Accordingly, the movable back plate 110 can be shifted in the direction of arrow (c) together with the shift frame 100 and the ejection tray 80 by the engagement of the pin 101 with the long hole 110*b*. Also, the movable back plate 110 is guided to be shifted by the engagement of the lateral long holes 110*a* with the pins 76. On the other hand, when the shift frame 100 is moved up and down together with the ejection tray 80 by the operation of the elevate block 130 as described later, the movable back plate 110 maintains its vertical position and does not move up and down since the pin 101 is guided by the long hole 110*b*. That is, the ejection rollers 95 and the actuator 86 vertically maintain their positions.

Figure 12:
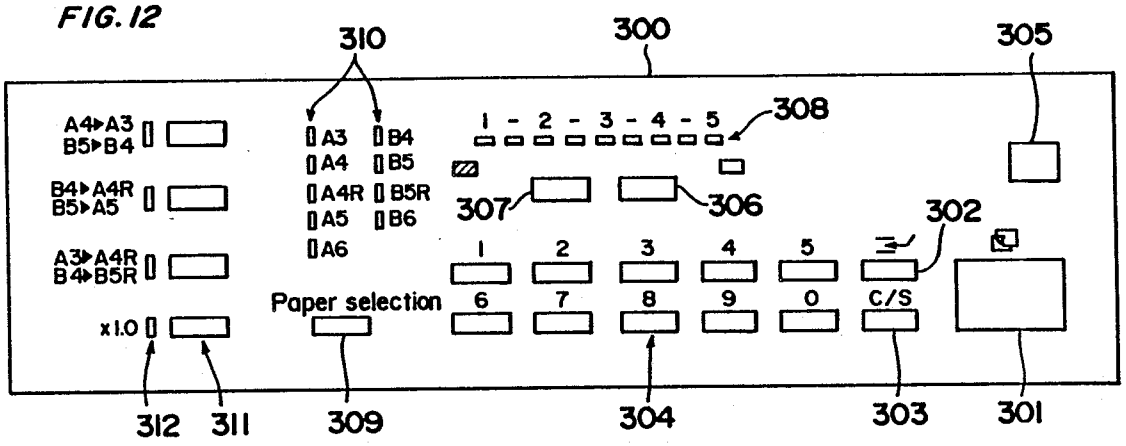
FIG. 12 is a plan view showing an operation panel of the copying machine.

The above-mentioned shifting is performed in the case of interruption copying operation as well as in the case of copying operation with use of the RDH 30. When an interruption key 302 (Refer to FIG. 12.) is pressed so as to select the interruption copying operation, the shift motor is turned on to shift the ejection tray 80. When the interruption key 302 is pressed again so that the completion of the interruption copying operation is confirmed, the shift motor is turned on again. However, in such a case of interruption copying operation, the shifting is not necessary unless there are some sheets on the ejection tray 80, so if there are no sheets on the ejection tray 80, the shifting is not performed. For that, a reactive photosensor SE9 for detecting the presence or the absence of sheets is disposed on the back side of the ejection tray 80. (Refer to FIG. 2 )

(Elevate block)

The elevate block 130 supports the shift block 90 and is designed to lift up and down the ejection tray 80.

Figure 7:
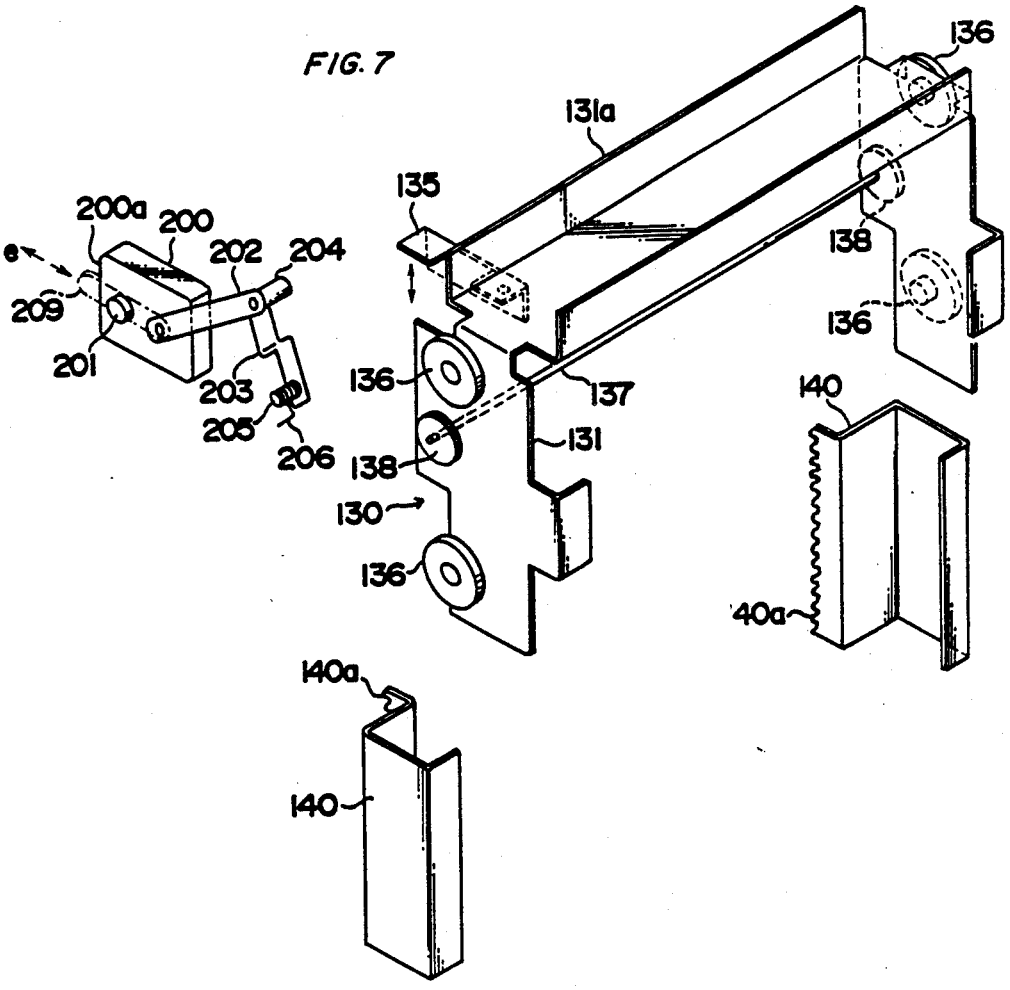
FIG. 7 is a perspective view showing an elevate block.

The elevate frame 131, which supports the shift frame 100 and enables it to be shifted as shown in FIG. 7, can be lifted up and down by the engagement of rotatable rollers 136 disposed on the both sides of the elevate frame 131 with the inside of guide frames 140 fastened to the main frame not shown in the drawings. This elevate frame 131 also has pinions 138 fastened to a shaft 137. These pinions 138 gear to racks 140*a* formed on the elevate guide frames 140 and are driven to rotate by a reversible elevate motor not shown in the drawings. The elevate frame 131 is moved up and down together with the shift frame 100 and the ejection tray 80 by the rotation of the pinions 138.

With the arrangement as described above, when the number of sheets ejected and stacked on the ejection tray 80 increases, and the upper surface of the copying paper lifts up the actuator 86 to operate the sensor SE3, the elevate motor is driven forward. Then, the elevate frame 131 is moved down together with the ejection tray 80. When the actuator 86 comes back to its place by the descent of the copying paper accompanying the descent of the ejection tray 80, so that the lever 87 intercepts the optical axis from the sensor SE3 again, the descent of the elevate frame 131 is stopped by the stoppage of the drive of the elevate motor. Thus and so, since the ejection tray 80 is intermittently moved down according to the volume of copying paper stacked thereon, the height which the trailing edge of a sheet falls down to the ejection tray 80 is automatically maintained within that calculated by the addition of the distance which the ejection tray 80 is moved down during the drive of the elevate motor to the distance between the nipping portion formed of the ejection rollers 95 and the balls 67 and the position where the actuator 86 detects the upper surface of the copying paper. The sheets of copying paper keep in alignment by the descent of the ejection tray 80 as well as by the aligning operation of the paddle wheels 99.

On the other hand, as shown in FIG. 2, sensors SE5 and SE6 are disposed under the elevate block 130. These sensors SE5 and SE6 function when a corner 131*b* of the elevate frame 131 intercepts the optical axes therefrom. When the sensor SE5 is actuated and the sensor SE3 detects the upper surface of the copying paper, which means that the ejection tray 80 fills with paper, a signal which indicates sheets of copying paper are stacked over the capacity is outputted to the copying machine 1, and if necessary, it is warned that the sheets should be taken away from the ejection tray 80.

Further, even when the sensor SE5 detects the descent of the elevate block 130, the elevate block 130 can afford to be moved down approximately 10 millimeters more. Accordingly, in this embodiment, even if the signal indicating the overstacking of copying paper is outputted in the middle of a cycle of copying operation with use of the RDH 30, the copying operation is not immediately discontinued but is controlled to be discontinued after the completion of the current cycle of copying operation. If copying operation is discontinued in the middle of its one cycle, the division of copying paper into sets by the shifting of the ejection tray 80 comes in vain, and also an operator should set the remaining documents of the set to resume the copying operation or should operate to make one more whole set. However, such trouble and inconvenience are prevented with this control system. The detailed procedure of this control system will be described later.

Additionally, the elevate frame 131 is moved down until its corner 131*b* is detected by the sensor SE6 so as to actuate the stamp 200.

(Stamp block)

The constitution of a stamp block is herewith explained.

As shown in FIG. 7, the stamp 200, which stamps the words "SECRET", "CIRCULAR NOTICE" etc. on a bundle of copying paper stored in the stapling tray 150 described later, is actuated by the elevate frame 131. The stamp 200 is set with its stamping surface 200*a* facing arrow (e), and a pin 201 can move in the direction of arrow (e) along a guide hole 209. This stamp 200 is linked with links 202 and 203 connected with each other by a pin 204, and the link 203 can pivot on a pin 205 and is always hung up by a coil spring 206.

A tab 135 which is fixed onto the lateral guide portion 131*a* of the elevate frame 131 presses the pin 204 by the descent of the elevate frame 131 to its lowest position, and the stamp 200 is moved in the direction of arrow (e) to stamp on the sheets in the stapling tray 150. The stamping operation is controlled to be executed immediately after the stapling operation by the stapler 190 as described later. The sensor SE6 is actuated at the time of stamping operation, and accordingly the elevate motor is driven in the reverse direction to lift up the elevate frame 131 to its initial position. The links 202 and 203 relieved from the pressure of the tab 135 are moved up by the elasticity of the coil spring 206 so that the stamp 200 returns to its initial position.

(Stapling tray)

The stapling tray 150, as shown in FIG. 2, is composed of a base plate 151, a guide plate 155 and a stopper 160 and stands with a slight inclination. The stopper 160 for regulating the bottom of sheets transported into the stapling tray 150 can pivot on a shaft 161 and is connected with an ejection solenoid not shown in the drawings. The stopper 160 usually closes the bottom of the stapling tray 150 engaging with the bottom portion of the guide plate 155 when the ejection solenoid is off. When the ejection solenoid is turned on, the stopper 160 is turned in the direction of arrow (f) on the shaft 161 to open the bottom of the stapling tray 150.

Figure 9:
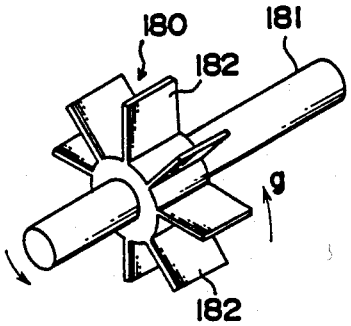
FIG. 9 is a perspective view showing a paddle wheel in a stapling tray.

Also, a paddle wheel 180 for aligning sheets of copying paper transported into the stapling tray 150, the stapler 190, a guide roller 195 and a sensor SE7 for detecting the presence or the absence of copying paper are disposed at the bottom portion of the stapling tray 150. The paddle wheel 180, as shown in FIG. 9, is equipped with radially-arranged flexible blades 182 around the shaft 181 and is driven to rotate in the direction of arrow (g). The flexible blades 182 touch the surfaces of sheets to provide a transport force in a specified direction with each of the sheets so that every sheet is transported into the stapling tray 150 correctly and aligned.

The stapler 190 is a conventional electric type, wherein a receiver is disposed on the plane common to the stopper 160, and staples a corner of a bundle of copying paper stored and aligned in the stapling tray 150.

The guide roller 195 which can rotate is fixed to the bottom portion of a lever 196 which can shake and is hung from the guide plate 155, and this roller 195 is especially for preventing the leading edges of sheets stored in the stapling tray 150 from bulging.

On the other hand, the top portion of the guide plate 155, which is extended to the neighborhood of the diverting member 70, guides sheets of copying paper to the stapling tray 150 in cooperation with the guide plate 69. Right above the stapling tray 150, transport rollers 165 and 166 for transporting sheets of copying paper into the stapling tray 150 and a sensor SE4 for detectIng the transported sheets.

Further, a regulating levers 156 and 157 and a neutralizing brush 158 for sheets of copying paper are provided for the guide plate 155. The regulating levers 156 and 157 come into the stapling tray 150 when solenoids SL1 and SL2 are turned on, and they can be moved to the positions shown by dashed lines in FIG. 2 respectively to regulate the sheets not to lean toward the guide plate 155 and to prevent page disorder of the sheets. The regulating levers 156 and 157 are set at the positions where the top edges of sheets stored in the stapling tray 150 are regulated thereby, according to the size of the sheets.

Next, the constitution for ejecting the stapled sheets from the stapling tray 150 is explained.

Figure 10:
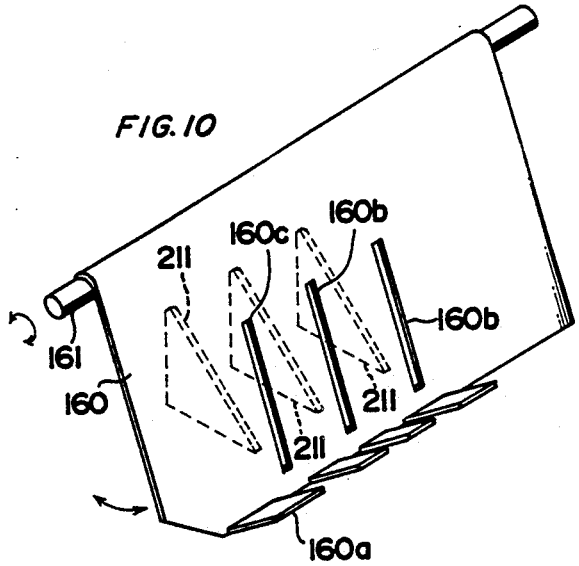
FIG. 10 is a perspective view showing a stopper of the stapling tray.

A frame 210 provided for the finisher unit 50 has tabs 211 disposed at the position where the tabs 211 face the bottom portion of sheets stored in the stapling tray 150, and as shown in FIG. 10, the stopper 160 has long holes **160*b* thereon corresponding to the tabs 211. Accordingly, when the stopper 160 is turned in the direction of arrow (f) to open the bottom of the stapling tray 150, the tabs 211 protrude through the long holes 160*b* to regulate the bottom portion of the sheets. This arrangement prevents the poor ejection which may be caused by the movement of the sheets in the direction of arrow (f) attached to the bottom portion 160*a* when the bottom of the stapling tray 150 is opened. Accordingly, the regulating surfaces of the tabs 211** are inclined so as to guide the sheets to the direction of the ejection.

Also, at the time of the ejection of sheets, the paddle wheel 180 is driven to rotate so as to provide a force in the direction of the ejection with the sheets.

Further, the stapled sheets are ejected into the stack box 220 (Refer to FIG. 1) guided by a guide plate 215. In this moment, the sheets are apt to be curled in the direction of arrow (h) by the heat of the fixing device 17 in the copying machine 1, so the sheets may be stored in the stacking tray 220 out of order only with the guidance of the guide plate 215. Accordingly, in this embodiment, a protrusion 216 is arranged at the center of the guide plate 215. This arrangement provides stiffness with the sheets being ejected to the stapling tray 220 so that the paper alignment in the stack box 220 is improved.

(Operation mode)

Operation modes of the finisher unit 50 are herewith explained.

A non-stapling mode is an operation mode wherein sheets of copying paper ejected from the copying machine 1 are stacked onto the ejection tray 80. In this mode, the diverting member 70 maintains its position at that shown by a solid line in FIG. 2 so that the sheets are ejected onto the ejection tray 80 through the ejection rollers 95 and the balls 67 and aligned by the rotation of the paddle wheels 99. Then, the elevate block 130 is operated as described above each time the sensor SE3 detects the upper surface of copying paper stacked onto the ejection tray 80 so that the height from the upper surface of copying paper to the nip portion formed of the ejection rollers 95 and the balls 67 is fixed.

The shifting of the ejection tray 80 by the operation of the shift block 90 is automatically performed when the number of copy sets to be made is designated more than "2", whether the RDH 30 is used or not. In such a case, each time the sensor SE2 detects the last sheet of a copy set being ejected after the completion of one cycle of copying operation, the ejection tray 80 is shifted right or left for the division of copying paper into sets.

A stapling mode is an operation mode wherein sheets of copying paper ejected from the copying machine 1 are stored in the stapling tray 150 to be stapled with the stapler 190 and the stapled sheets are ejected therefrom and stacked in the stack box 220. In this mode, the diverting member 70 is set at the position shown by a dashed line in FIG. 2 so that the sheets are transported into the stapling tray 150 through the transport rollers 165 and aligned by the rotation of the paddle wheel 180. Then, when the last sheet of a set of copying paper corresponding to a set of original documents finishes to be aligned, the stapler 190 is driven.

A stamping mode is an operation mode wherein the stamp 200 stamps on the first page of a bundle of copying paper stored in the stapling tray 150. In this embodiment, the stamping mode is available only when the operation in the stapling mode and is executed right after the stapling operation. In this case, the elevate frame 131 is moved down together with the ejection tray 80 by the operation of the elevate block 130 until the corner **131*b* of the elevate frame 131** is detected by the sensor SE6, and then the stamp 200 is moved to stamp by the cooperation of the links 202 and 203 with each other (Control panel)

Figure 14:
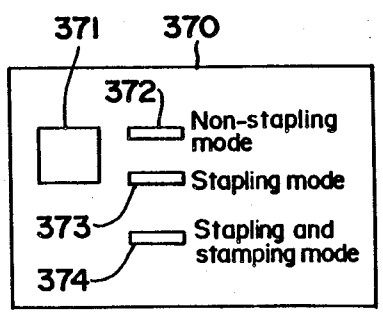
FIG. 14 is a plan view showing an operation panel of the finisher unit.
Figure 13:
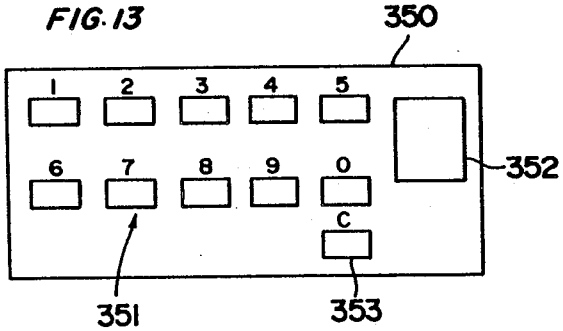
FIG. 13 is a plan view showing an operation panel of a recirculating document handling device.

Regarding control panels, in this embodiment, a control panel 300 of the copying machine 1 (Refer to FIG. 12.), a control panel 350 of the RDH 30 (Refer to FIG. 13.) and a control panel 370 of the finisher unit 50 (Refer to FIG. 14.) are installed.

The control panel 300 of the copying machine 1 is disposed on the top front portion of the copying machine 1, and it comprises a print key 301 for starting a copying operation, an interruption key 302 for interrupting a multicopying operation temporarily, a clear/-stop key 303 for stopping a copying operation or canceling the inputted number of copy sets, a ten-key 304 for setting the number of copy sets, an indicator 305 for indicating the number of copy sets and the condition of the copying machine 1, up/down keys 306 and 307 for setting the density for copy images, LEDs 308 for indicating the density for copy images, a paper selection key 309 for selecting a sheet size of copying paper, LEDs 310 indicating the selected sheet size, a magnification select key group 311 for selecting a magnification for the copy operation out of some preset magnifications and LEDs 312 for indicating the selected magnification. Additionally, on the key top of the print key 301, some information such as a paper jam and emptiness of the toner is indicated The control panel 350 of the RDH 30 comprises a ten-key 351 for inputting the number of original documents, an indicator 352 for indicating the inputted number of original documents and a cancel key 353 for canceling the indication of the inputted number of original documents. Further, the input of the number of original documents with the ten-key 351 is necessary only when original documents are set on the tray 31 of the RDH 30, and accordingly a sensor not shown in the drawings is provided for the tray 31 to detect the presence or the absence of original documents.

Also, the control panel 370 of the finisher unit 50 comprises a mode selection key 371, an LED 372 for indicating the non-stapling mode, an LED 373 for indicating the stapling mode and an LED 374 for indicating the stapling and stamping mode. When a power switch is turned on, the operation mode is reset at the non stapling mode. Thereafter, each time the mode selection key 371 is pressed, the operation mode is orderly changed to the stapling mode, to the stapling and stamping mode and then to the non-stapling mode, and the corresponding LEDs 372, 373 and 374 are accordingly lighted.

(Control circuit)

Figure 15:
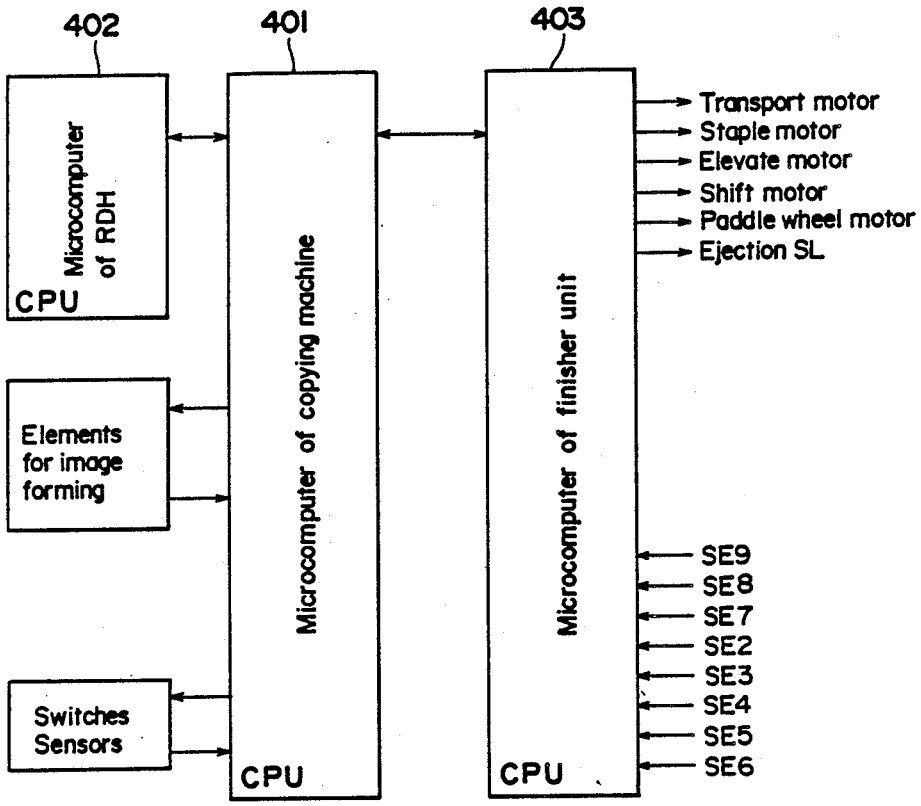
FIG. 15 is a block diagram showing a control circuit.

FIG. 15 shows a control circuit of the copying machine 1, the RDH 30 and the finisher unit 50.

The control is executed mainly by a microcomputer (which is hereinafter referred to as CPU) 401 of the copying machine 1, a CPU 402 of the RDH and a CPU 403 of the finisher unit. The CPU 401 is connected to all elements for image forming and many of the switches and the sensors. The CPU 403 is connected to the transport motor, the staple motor, the elevate motor, the shift motor, the paddle wheel motor, the ejection solenoid etc. and the sensors SE2 through SE9. The CPU 401 exchanges signals with the CPU 402 and the CPU 403 to execute the necessary processing.

(Control Procedure)

The control procedures of the copying machine 1, the RDH 30 and the finisher unit 50 based on the control circuit are herewith explained.

In the following paragraphs, the term "on-edge" is defined as change in status where a switch, a sensor, a signal or the like changes from the off status to the on status. In contrast, the term "off-edge" represents change in status where a switch, a sensor, a signal or the like changes from the on status to the off status. Further, the sensors SE1, SE2 and SE4, which have points of contact, are turned on when they detect sheets of copying paper, and the photosensors SE5, SE6, SE7 and SE9, which do not have any points of contact, are turned off when sheets of copying paper or the like intercept their optical axes.

Figure 16:
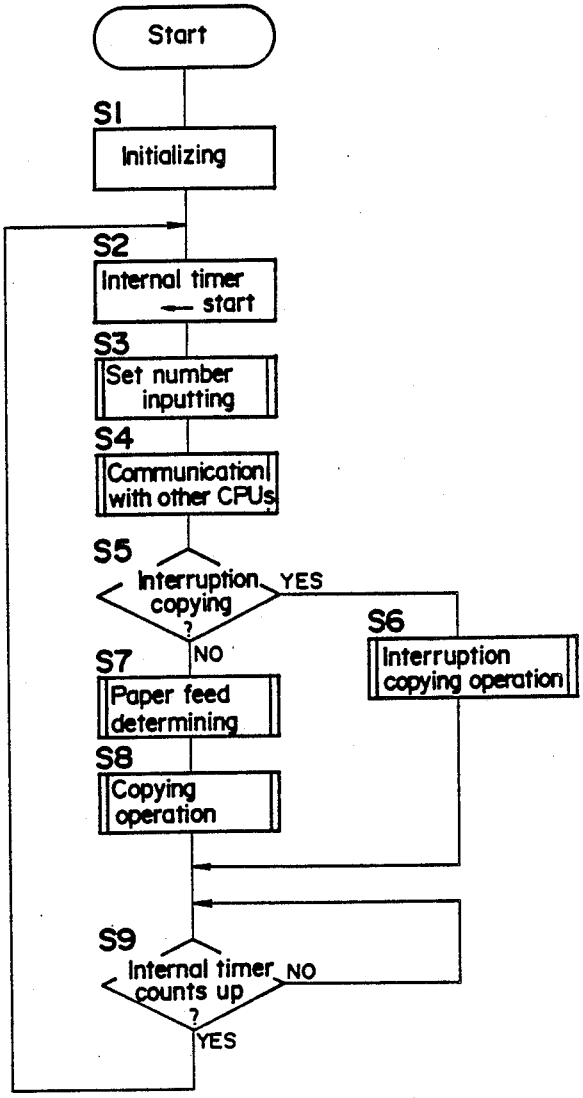
FIG. 16 is a flow chart showing a main routine of CPU 401.

FIG. 16 shows a main routine of the CPU 401 of the copying machine 1.

When the CPU 401 is reset and the program is started, first at step S1, the clearance of a random access memory and the initialization of various registers are executed to reset them at the initial mode. Next, an internal timer is started at step S2. The internal timer is for setting the time required for one cycle of the main routine, and it is set at step S1.

Next, a set number inputted with the ten-key 304 is received at step S3, and a communication process of CPU 401 with the other CPUs 402 and 403 is executed at step S4. Subsequently, it is judged at step S5 whether the interruption copying operation is selected or not, and if it is selected, a process for the interruption copying operation is executed at step S6, and the processing goes to step S9. If the interruption copying operation is not selected, a process for determining a sheet size of copying paper to be supplied is executed at step S7, a process for forming images is executed at step S8, and the processing goes to step S9.

Next, after it is confirmed at step S9 that the internal timer counts up the time, the processing returns to step S2. Various counting processes with various counters during the execution of subroutines are based on the time required for one cycle of this main routine.

Further, a subroutine for the input of a set number to be executed at step S3 and a subroutine for the image forming to be executed at step S8 are so well-known that the detailed description of them are omitted.

Figure 17:
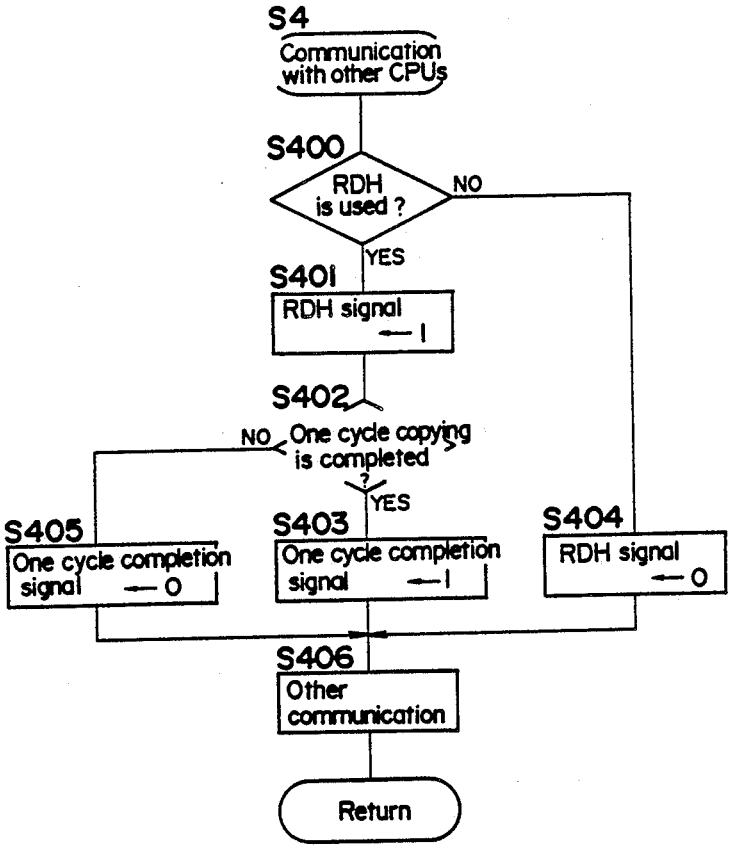
FIG. 17 is a flow chart showing a subroutine for the communication process with CPUs 402 and 403.

FIG. 17 shows a subroutine for the communication process of CPU 401 with the other CPUs 402 and 403 to be executed at step S4 of the main routine.

First, it is checked at step S400 whether the RDH 30 is currently used or not. If it is not used, an RDH signal is reset at "0" at step S404, and the processing goes to step S406. If it is used, the RDH signal is set at "1" at step S401, and it is checked at step S402 whether one cycle of copying operation of original documents placed on the tray 31 is completed or not. If it is completed, a one cycle completion signal is set at "1" at step S403, and the processing goes to step S406. If it is not completed, the one cycle completion signal is reset at "0" at step S405, and the processing goes to step S406. Other communications between the CPU 401 and the CPUs 402 and 403 are performed at step S406, and this subroutine is terminated.

Figure 18:
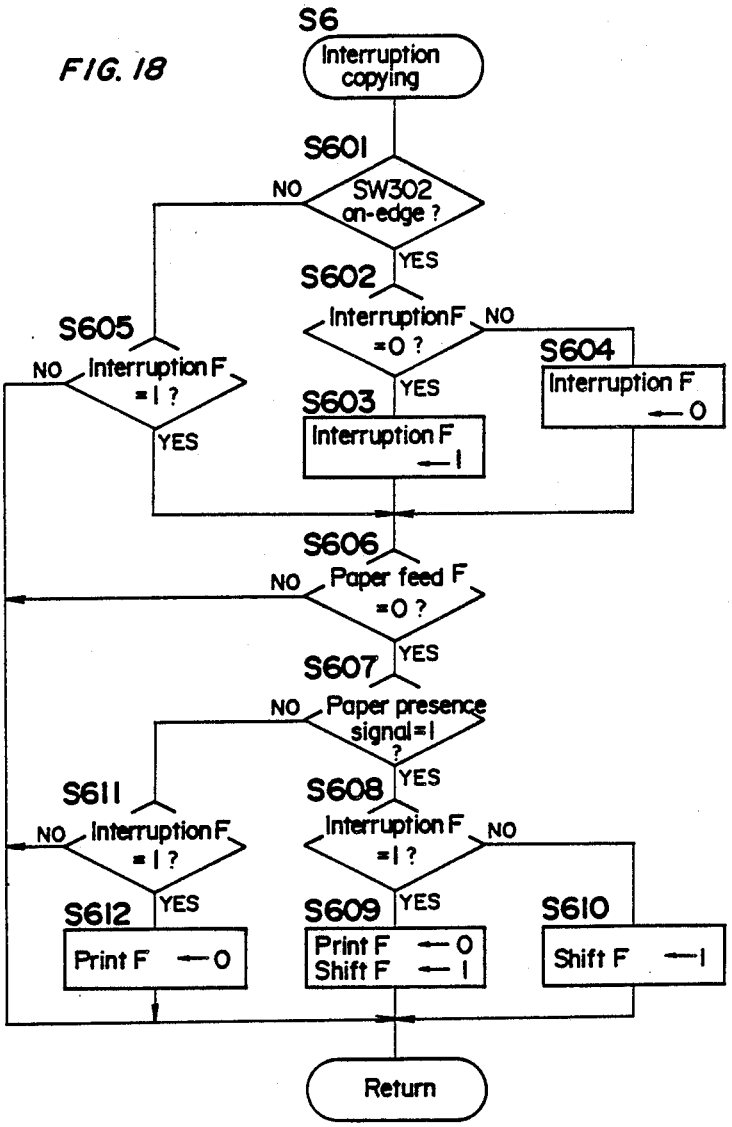
FIG. 18 is a flow chart showing a subroutine for the interruption copying operation.

FIG. 18 shows a subroutine for the interruption copying operation to be executed at step S6 of the main routine.

First, it is checked at step S601 whether the interruption switch 302 is on-edge or not. If it is on-edge, it is checked at step S602 whether an interruption flag is at "0" or not. If it is at "0", which means that the interruption copying operation is not currently selected, the interruption flag is set at "1" at step S603, and the processing goes to step S606. If the interruption flag is at "1", which means that the interruption copying operation is currently selected, the interruption flag is reset at "0" at step S604 to cancel the interruption copying operation, and the processing goes to step S606. On the other hand, the interruption switch 302 is not on-edge, it is checked at step S605 whether the interruption flag is at "1" or not. If it is at "0", the processing immediately returns to the main routine. If it is at "1", the processing goes to step S606 to execute the interruption copying operation.

Next, it is checked at step S606 whether a paper feed flag is at "0" or not. If it is at "1", which means that a sheet of copying paper is currently being supplied, this subroutine is immediately terminated. If it is at "0", it is checked at step S607 whether a paper presence signal is at "1" or not. The paper presence signal is outputted from the CPU 403 in response to a signal from the copying paper detecting sensor SE9 Provided for the ejection tray 80, and the signal indicates the presence of copying paper when at "1" and the absence of copying paper when at "0", If the paper presence signal is at "1", and also it is judged at step S608 that the interruption flag is at "1", at step S609, a print flag is set at "0", and a shift flag is set at "1". That is, the copying operation is discontinued, and the preparation for the shifting of the ejection tray 80 is made. If it is judged at step S608 that the interruption flag is at "0", the shift flag is set at "1" at step S610. That is, when the interruption copying operation is completed, the preparation of the shifting of the ejection tray 80 is made upon the confirmation of the presence of copying paper on the ejection tray 80, too.

On the other hand, if it is judged at step S607 that the copying paper presence signal is at "0", it is checked at step S611 whether the interruption flag is at "1" or not. If it is at "1", the print flag is reset at "0" at step S612, and the processing returns to the main routine. If it is at "0", the processing immediately returns to the main routine.

Figure 19A:
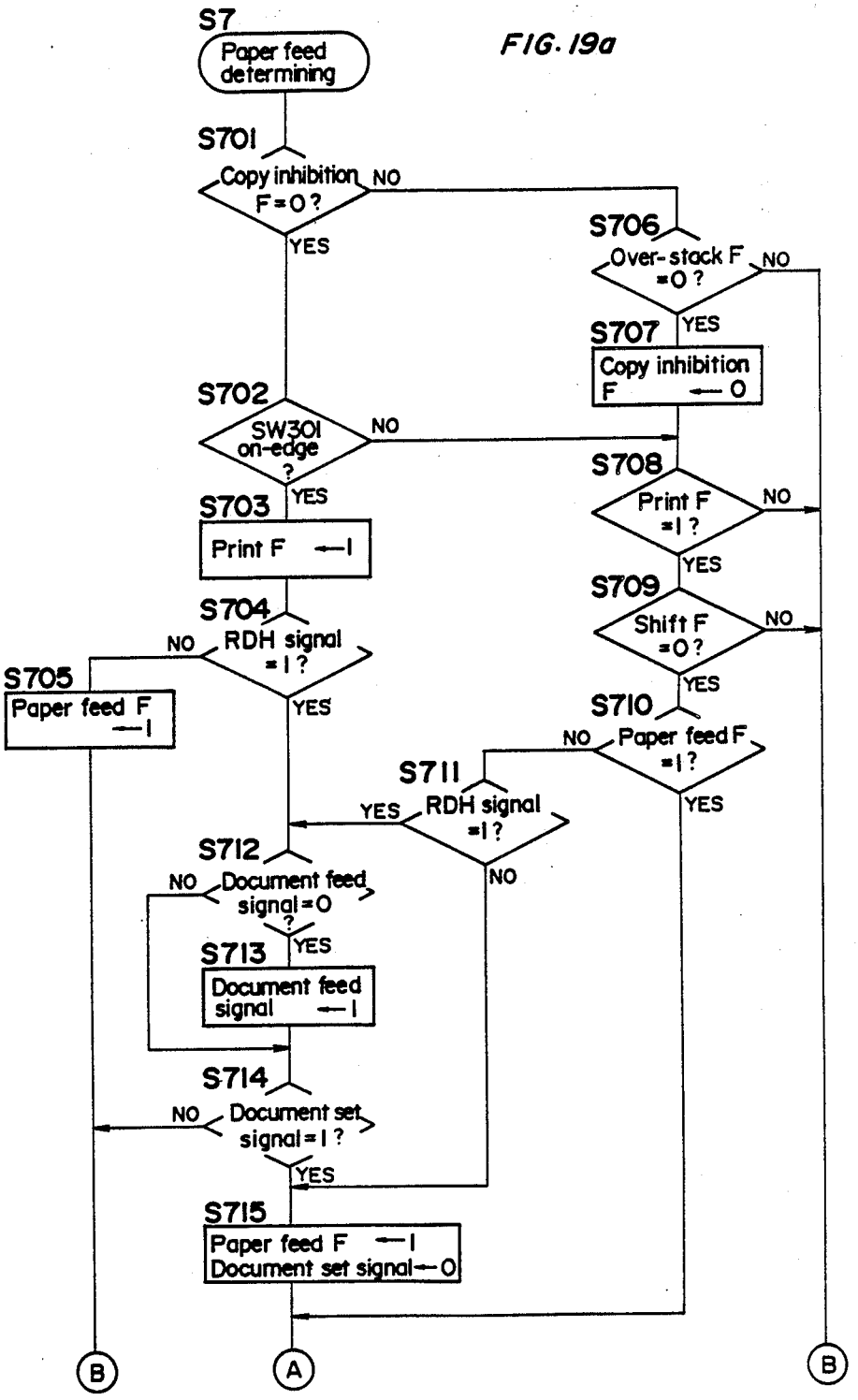
FIGS. 19*a* and 19*b* are flow charts showing a subroutine for the determination of paper feeding.
Figure 19B:
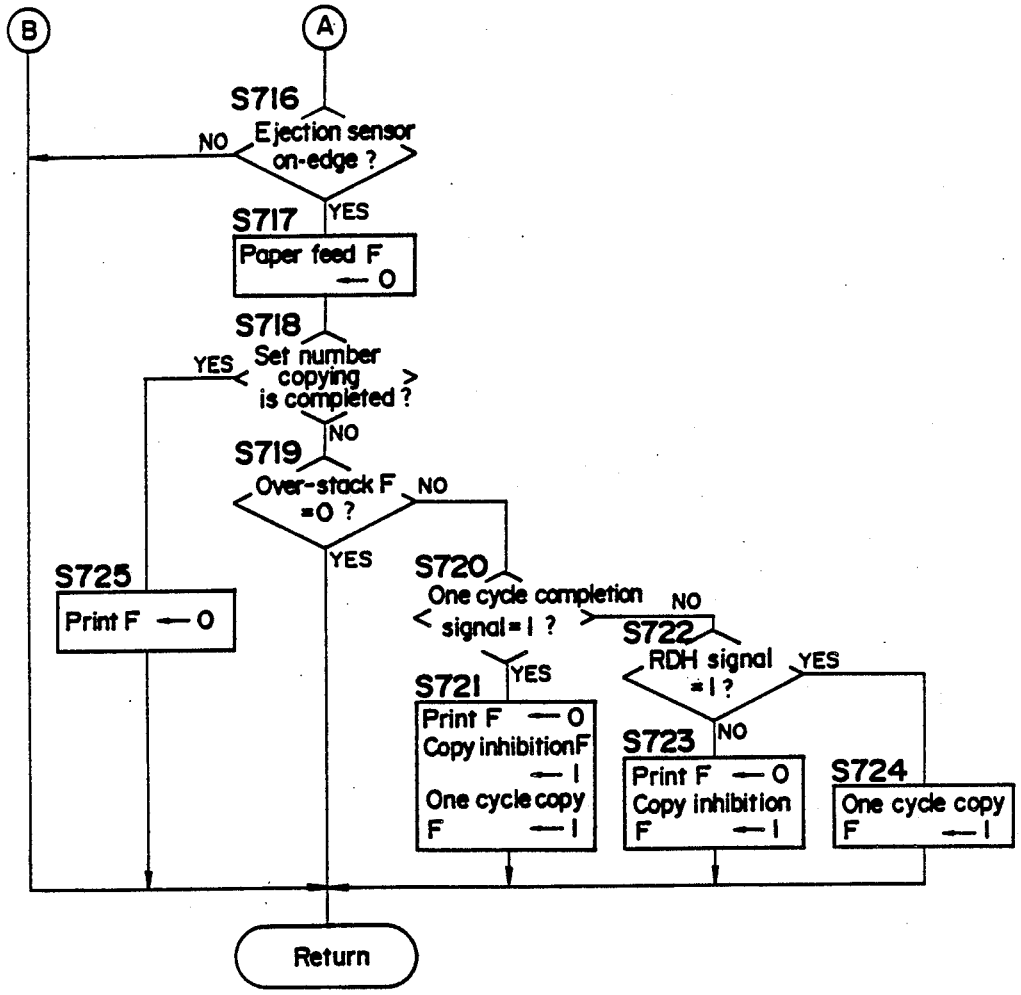

FIGS. 19*a* and 19*b* show a subroutine for the determination of a sheet size of copying paper to be supplied which is executed at step S7 of the main routine.

First, it is checked at step S701 whether a copy inhibition flag is at "0" or not. The copy inhibition flag is set at "1" in response to an over-stack flag outputted from the CPU 403 of the finisher unit 50 and the one cycle completion signal outputted from the CPU 402 of the RDH 30. (Refer to steps S719, S721 and S7Z3 explained later.) If the copy inhibition flag is at "0", it is checked at step S702 whether the print switch 301 is on-edge or not. If it is on-edge, the print flag is set at "1" at step S703. Subsequently, it is checked at step S704 whether the RDH signal is at "1" or not. If it is at "0", the paper feed flag is set at "1" at step S705, and the processing returns to the main routine. When the paper feed flag is set at "1", a sheet of copying paper is allowed to be supplied from the cassette 10 or the cassette 11 which was selected by an operator in advance.

If it is judged at step S704 that the RDH signal is at "1", it is checked at step S712 whether an original document feed signal is at "0" or not. The original document feed signal is for executing the feed of original documents by the RDH 30, and if the signal is at "0" at that time, it is set at "1" at step S713. Subsequently, after it is confirmed at step S714 that an original document set signal is at "1", the paper feed flag is set at "1" while the original document feed signal is reset at "0" at step S715. The original document set signal, which is outputted from the CPU 402 of the RDH 30, is set at "1" when an original document is fed and reaches the place where the copying operation of the document is able to start.

Next, after waiting the on-edge of the ejection sensor SE1 of the copying machine 1 at step S716, that is, when a sheet of copying paper formed an image thereon reaches the ejection portion of the copying machine 1, the paper feed flag is reset at "0" at step S717. Subsequently, it is checked at step S718 whether the image forming for the inputted number of copy sets is completed or not. If it is completed, the print flag is reset at "0" at step S725, and this subroutine is terminated. If not, it is checked at step S719 whether the over-stack flag is at "0" or not. When the ejection tray 80 is filled with copying paper, the over-stack flag is set at "1" in response to a signal outputted from the CPU 403 of the finisher unit 50 according to signals outputted from the sensors SE5 and SE3. If the over-stack flag is at "0", this subroutine is terminated, and if the over-stack flag is at "1", it is checked at step S720 whether the one cycle completion flag is at "1" or not. The one cycle completion flag is at "1" to output a signal from the CPU 402 of the RDH 30 when one cycle of copying operation of the original documents placed on the tray 31 is completed. After the one cycle completion flag is set at "1", the print flag and a one cycle copy flag are reset at "0" while a copy inhibition flag is set at "1" at step S721 and then the processing returns to the main routine. If the one cycle completion flag is at "0", it is checked at step S722 whether the RDH signal is at "1" or not. If it is at "0", the print flag is reset at "0" while the copy inhibition flag is at "1" at step S723, and then the processing returns to the main routine. If it is at "1", the one cycle copy flag is set at "1" at step S724, and this subroutine is terminated. When the one cycle copy flag is set at "1", one cycle of copying operation is executed, and the flag is reset at "0" simultaneously with the completion of one cycle of copying operation. Without use of the RDH 30, the one cycle copy flag keeps at "0".

On the other hand, it is judged at step S701 that the copy inhibition flag is set at "1", it is checked at step S706 whether the over-stack flag is at "0" or not. If it is at "1", this subroutine is immediately terminated. If it is at "0", the copy inhibition flag is reset at "0" at step S707. Subsequently, it is checked at step S708 whether the print flag is at "1" or not, and it is checked at step S709 whether the shift flag is at "0". If either the judgment at step S708 or the judgment at step S709 is "NO", this subroutine is terminated. If both of the results at steps S708 and S709 are "YES", which means that the copying operation is allowed and that the shifting is not necessary, it is checked at step S710 whether the paper feed flag is at "1" or not. If it is at "1", the processing goes to step S716 to perform the process of completing making one copy sheet. If it is at "0", it is checked at step S711 whether the RDH signal is at "1" or not. If it is at "1", which means that the RDH 30 is currently used, the processing goes to step S712 and the following steps. If the RDH signal is at "0", the process at step S715 is performed as described above, and then the processing goes to step S716.

Also, if the copy inhibition flag is at "0", and the print switch 301 is not judged to be on-edge at step S702, the processing goes to step S708.

Figure 20:
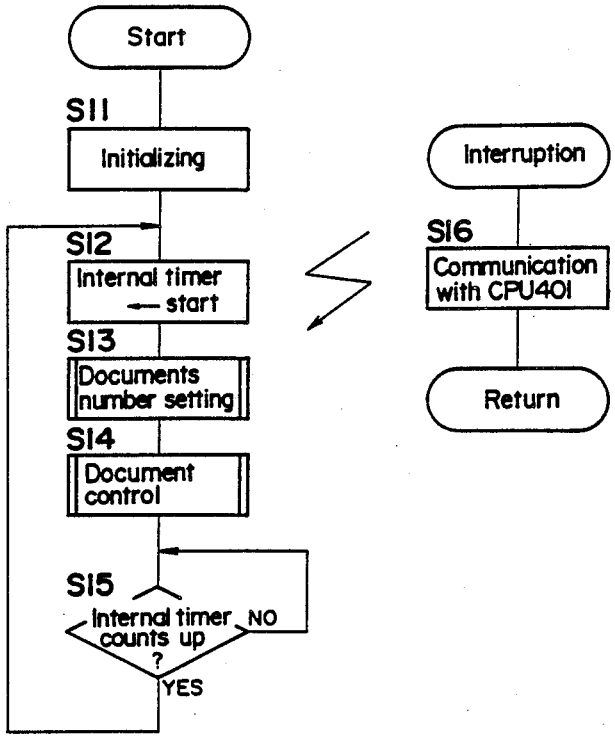
FIG. 20 is a flow chart showing a main routine of the CPU 402.

FIG. 20 shows a main routine which the CPU 402 of the RDH 30 performs.

When the CPU 402 is all reset, and the program is started, first, the initialization is executed at step S11 in the same manner as that executed at step S1.

Next, an internal timer is started at step S12, the number of original documents inputted with the ten-key 351 is received at step S13, the original documents are fed one by one to be placed on a specified position on the document deck glass 9 and ejected to be returned one by one to the tray 31 after the exposure of the image at step S14.

Next, it is confirmed at step S15 that the internal timer counts up the time, and then the processing returns to step S12. Each timer in each subroutine counts up the time by using the time required for one cycle of this main routine in the same way as the processing with the CPU 401 of the copying machine 1.

Also, when a request for the interruption operation is outputted from the CPU 401 of the copying machine 1, the CPU 402 of the RDH 30 corresponds with the CPU 401 at step S16.

Further, the processes at steps S13 and S14 are so well-known as a control of this type of the RDH 30 that the detailed description of them is omitted.

Figure 21:
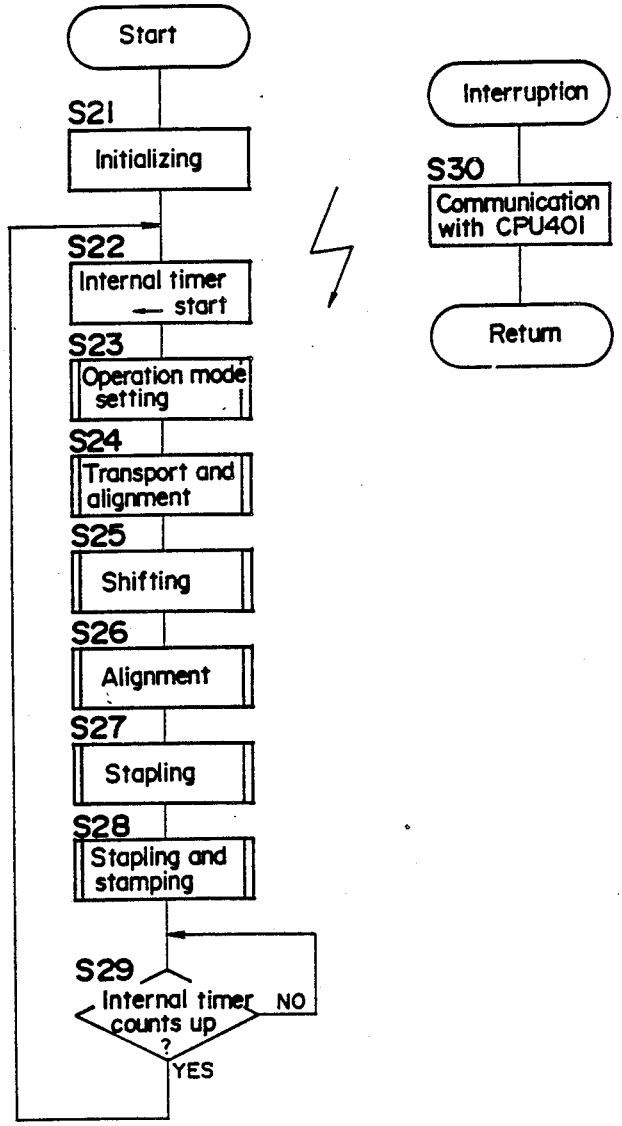
FIG. 21 is a flow chart showing a main routine of the CPU 403.

FIG. 21 shows a main routine which the CPU 403 of the finisher unit 50 performs.

When the CPU 403 is all reset, and the program is started, first, at step S21, a random access memory is cleared and every register is initialized to reset all devices at the initial mode. Next, an internal timer is started at step S22. The internal timer determines the time required for one cycle of this main routine, and the numerical value is predetermined at step S21.

Subsequently, subroutines to be executed at steps S23 through S28 are called and executed, and when the processes of all the subroutines are completed, it is confirmed at step S29 that the internal timer counts up the time, and then the processing returns to step S22. The counting with each timer in each subroutine is based on the time required for one cycle of this main routine.

Step S23 is a subroutine !or the setting of the operation mode of the finisher unit 50 by an operator. Step S24 is a subroutine for the transport and alignment of copying paper onto the ejection tray 80 when the non-stapling mode is selected. Step S25 is a subroutine for the shifting of the ejection tray 80. Step S26 is a subroutine for the transport and storing of copying paper into the stapling tray 150 and the alignment of each sheet therein when the stapling mode or the stapling and stamping mode is selected, and at this step, the alignment flag is set at "1" simultaneously with the completion of the alignment of one set of copying paper. The detailed description of this subroutine is omitted. Step S27 is a subroutine for the stapling operation to staple one set of copying paper already aligned in the stapling tray 150 and the ejection of the bound paper into the stack box 220. Step S28 is a subroutine for the stamping on the bound paper with the stamp 200.

On the other hand, when a request for the interruption operation is outputted from the CPU 401 of the copying machine 1 in the middle of the procedure of this main routine, the CPU 403 of the finisher unit 50 corresponds with the CPU 401 at step S30.

Figure 22:
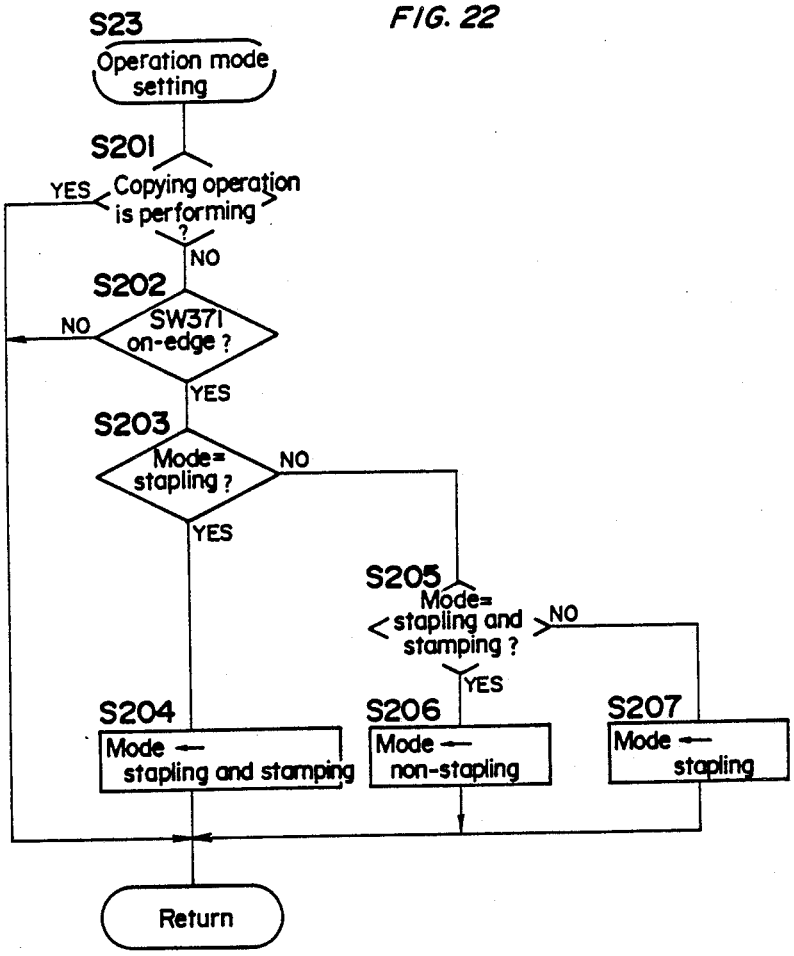
FIG. 22 is a flow chart showing a subroutine for the operation mode setting.

FIG. 22 shows a subroutine for the operation mode setting be executed at steP S23.

After it is confirmed at step S201 that the copying machine 1 is not currently in operation, it is checked at step S202 whether the mode selection switch 371 is on-edge or not. If it is on-edge, it is checked at steps S203 and S205 whether the current operation mode is either the stapling mode or the stapling and stamping mode or neither.

If the operation mode is the stapling mode at this moment, at step S204, the LED 374 is lighted while the mode is changed to the stapling and stamping mode. If the operation mode is the stapling and stamping mode, at step S206, the LED 372 is lighted while the mode is changed to the non-stapling mode. If the operation mode is the non-stapling mode, that is, if both of the results at steps S203 and S205 are "NO", at step S207, the LED 373 is lighted while the mode is changed to the stapling mode.

Figure 23A:
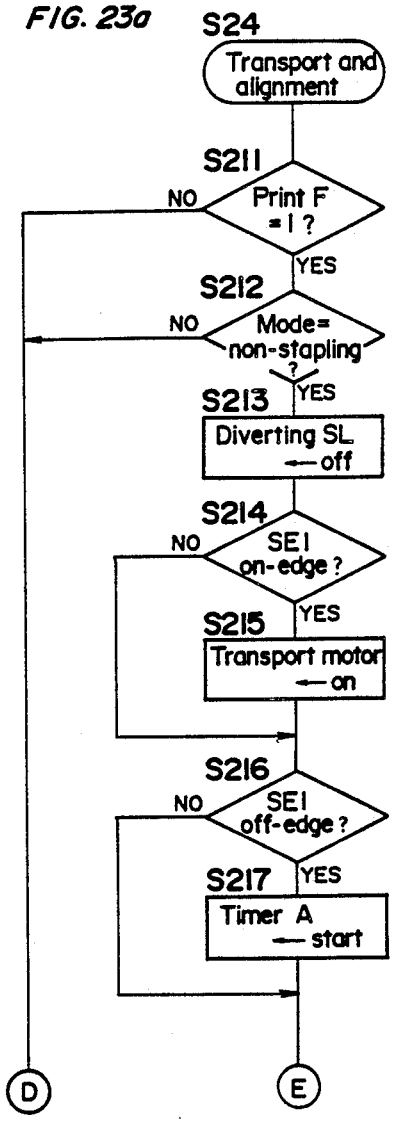
FIGS. 23*a*, 23*b* and 23*c* are flow charts showing a subroutine for the transport/alignment.
Figure 23B:
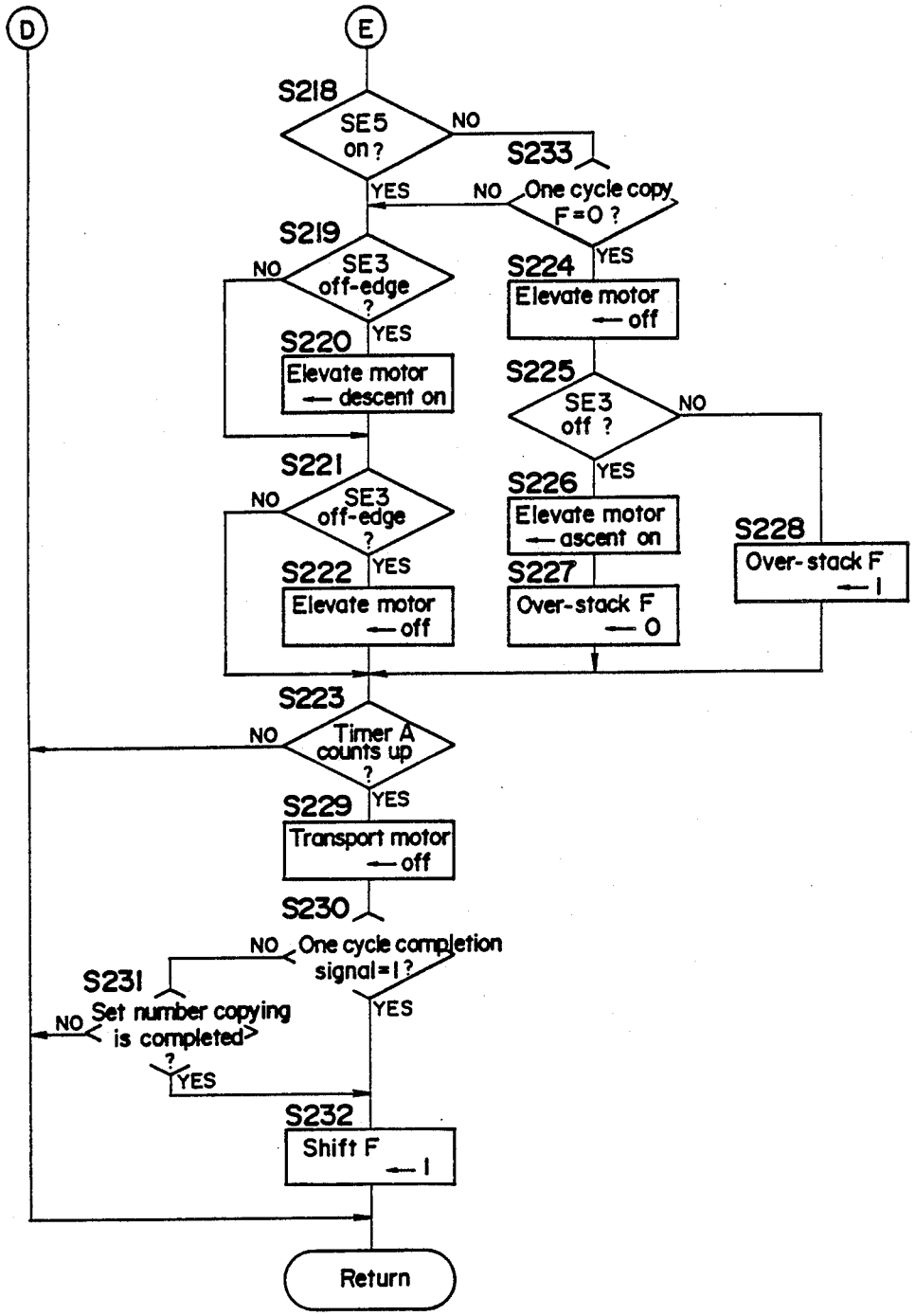

FIGS. 23*a* and 23*b* show a subroutine for the transport/alignment to be executed at step S24.

After the print flag is confirmed to be at "1" at step S211 and the mode flag is confirmed to be at the non stapling mode at step S212, the solenoid of the diverting member 70 is turned off at step S213 to keep the diverting member 70 at the position shown by a solid line in FIG. 2. Subsequently if the ejection sensor SE1 is judged to be on-edge at step S214, which means that the leading edge of a sheet of copying paper has reached the sensor SE1, the transport motor is turned on at step S215. Thereby, the rollers 60 and 95, the paddle wheels 99 etc. are driven to rotate. If the ejection sensor SE1 is judged to be off-edge at steP S216 the timer (A) is started at step S217, and the processing goes to step S218. In the timer (A), the time required until the sheet is aligned on the ejection tray 80 is set.

It is checked at step S218 whether the over-stack sensor SE5 has been turned on or not, that is whether the ejection tray 80 has been moved down to the lowest position or not. If the ejection tray 80 has not been moved down to the lowest position yet, that is, if the sensor SE5 is on, it is checked at step S219 whether the sensor SE3 for detecting the upper surface of :copying paper is on-edge or not. If the sensor SE3 is on-edge, which means that the stacking of the sheets onto the ejection tray 80 has reached the limit, the elevate motor is turned on at step S220 to move the ejection tray 80 downward. Subsequently, if the sensor SE3 is judged to be off edge at step S221, which means that the space above the upper surface of copying paper on the ejection tray 80 has recovered the predetermined level on account of the descent of the ejection tray 80, the elevate motor is turned off at step S222. Further, after the confirmation of the timer (A)'s counting up at step S223, the transport motor is turned off at step S229.

On the other hand, if the sensor SE5 has been already turned off, which means that the ejection tray 80 has been already moved down to the lowest position, after the confirmation at step S233 that the one cycle copy flag is at "0", the elevate motor is turned off at step S224 and it is checked at step S225 whether the sensor SE3 is off or not. If the sensor SE3 is on, which means that the ejection tray 80 is filled with sheets of copying paper, the over-stack flag is set at "1" at step S228, and the processing goes to step S223. If the one cycle copy flag is judged to be at "1" at step S233, the processing goes to step S219. With this arrangement, the space above the upper surface of copying paper on the ejection tray 80 can be maintained within a specified range even after the sensor SE5 detects the limit so that the effective alignment of the sheets to be ejected thereon is guaranteed. Further, even if the over stack flag has been set at "1", if one cycle of copying operation with use of the RDH 30 is not completed, the current cycle of copying operation is continued as mentioned above (Refer to steps S719, S720 and S722.)

Figure 23C:
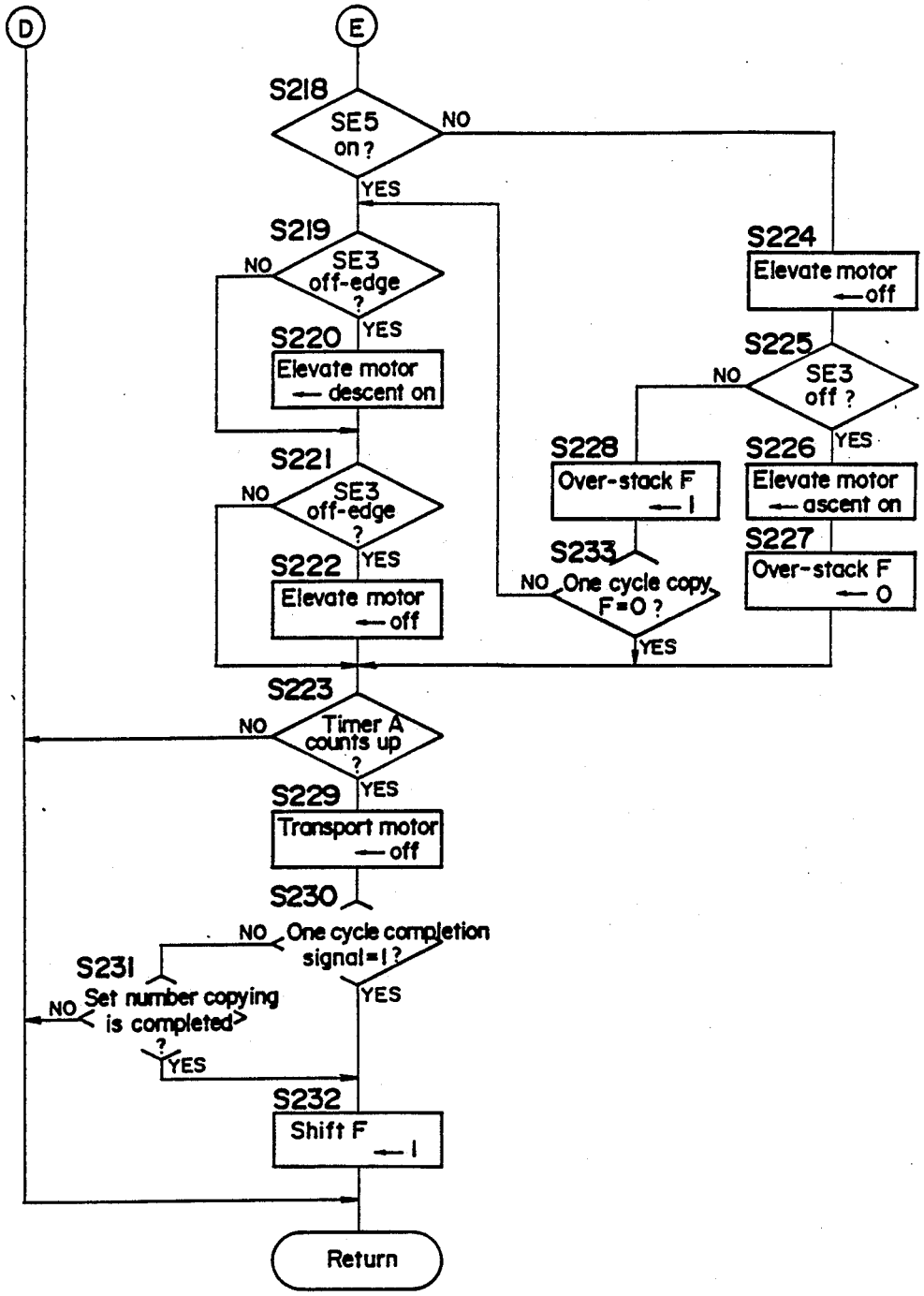

Also, even if the sheets stacked on the ejection tray 80 are taken away therefrom in the middle of copying operation with use of the RDH 30, the ejection tray 80 does not move upward. Thereby, the sheets to be ejected onto the ejection tray 80 thereafter are not aligned by the paddle wheels 99. That is, unless the one cycle copy flag is judged to be at "0" at step S233, the processing can not proceed to step S226. The one cycle copy flag is reset at "0" when one cycle of copying operation is completed (Refer to steps S720 and S721.) This arrangement can prevent trouble that when the sheets on the ejection tray 80 are not all taken away therefrom and some of them are left behind thereon, the next coming sheets are ejected onto the left sheets and aligned all together, so that the currently ejected sheets can not distinguished from the left sheets On the other hand, when the ejection tray 80 does not move up with this arrangement, since the next coming sheets are just ejected without any transport force, the sheets may fall from the ejection tray 80. To prevent the trouble, for example, as a flowchart shown in FIG. 23*c*, the judgment at step S233 can be performed after step S228. In this case, whether the one cycle copy flag is at "1" or "0", when the sensor SE3 is turned off, the ejection tray 80 moves upward, so that the paddle wheels 99 always touch a sheet to transport the sheet onto the ejection tray 80 correctly and align the sheet.

Further, if the sensor SE3 is judged to be off at step S225, the elevate motor is turned on at step S226 to move the ejection tray 80 upward, the over-stack flag is reset at "0" at step S227, and the processing goes to step S229.

When a sheet is finished to be transported onto and aligned on the ejection tray 80, the transport motor is turned off at step S229, and then it is checked at step S230 whether the one cycle completion signal is at "1" or not. If it is at "1", the shift flag is set at "1" at step S232, and the processing returns to the main routine. Even if the one cycle completion flag is at "0" when it is confirmed at step S231 that cycles of copying operation corresponding with the number of copy sets previously inputted are completed, the shift flag is set at "1" at step S232, and the processing returns to the main routine.

Figure 24:
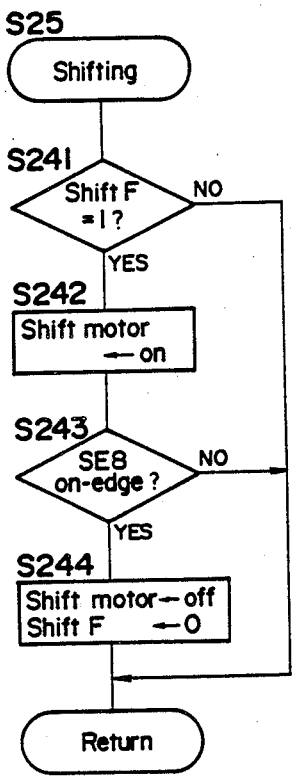
FIG. 24 is a flow chart showing a subroutine for the shifting operation.

FIG. 24 shows a subroutine for the shifting of the ejection tray 80 to be executed at step S25 of the main routine.

First, it is checked at step S241 whether the shift flag is at "1" or not. The shift flag is set at "1" (Refer to step S232.) before and after the interruption copying operation (Refer to steps S609 and 8610.), when one cycle of copying operation with use of the RDH 30 is completed, or when cycles of copying operation are repeated to complete making the inputted number of copy sets. If the shift flag is at "1", the shift motor is turned on at step S242. Next if the sensor SE8 is judged to be on-edge at step S243 which means that the shifting of the ejection tray 80 is completed at step S244, the shift motor is turned off, and the shift flag is reset at "0".

Additionally, when the shift flag is set at "1" at step S232, the paddle wheels 99 have stopped rotating accompanied with that the transport motor was turned off at step S229. Accordingly, the paddle wheels 99 with its rotation stopped are shifted synchronized with the shifting of the ejection tray 80 so as not to put the sheets on the ejection tray 80 out of alignment.

Figure 25:
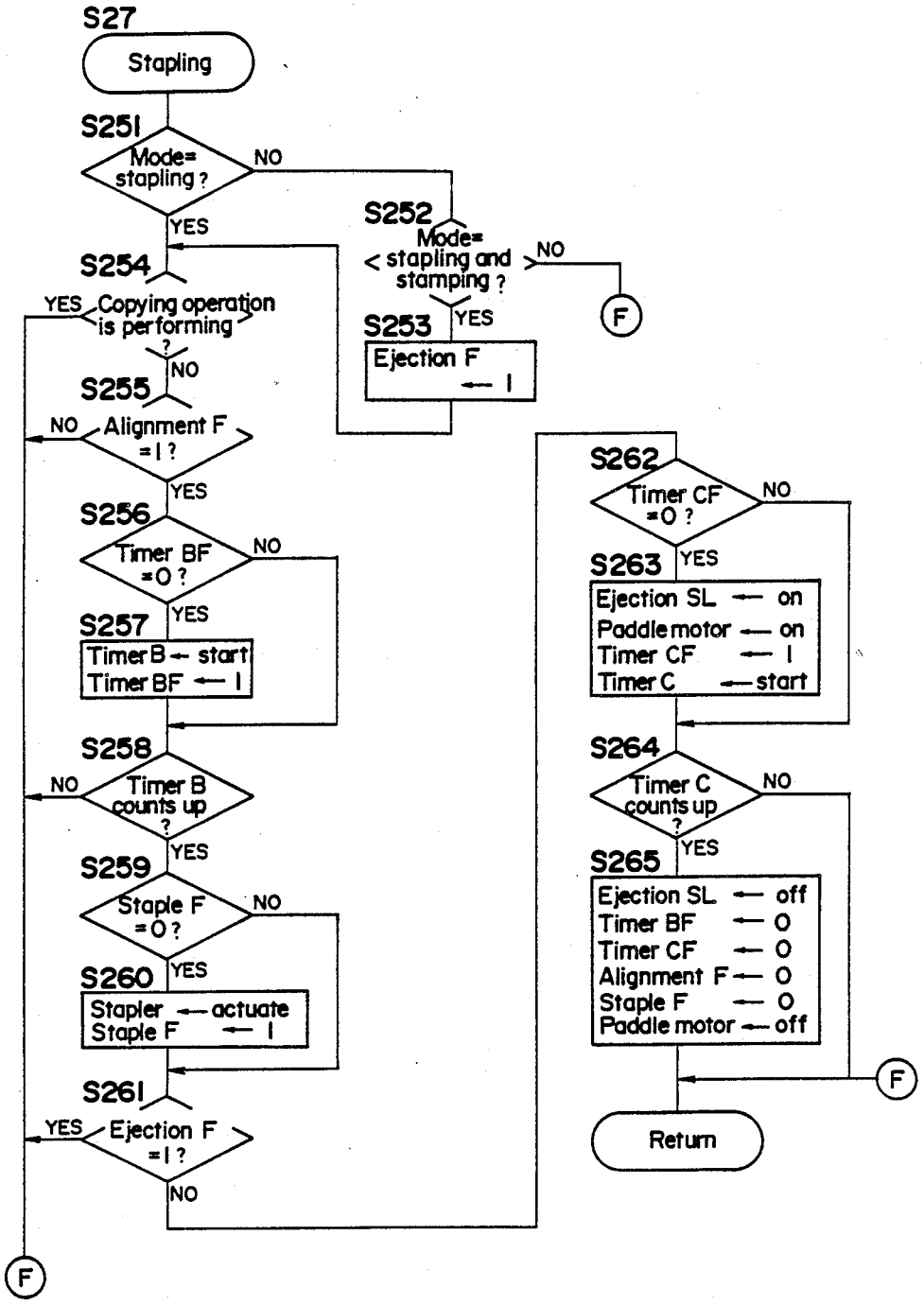
FIG. 25 is a flow chart showing a subroutine for the stapling operation.

FIG. 25 shows a subroutine for the operation in the stapling mode to be executed at step S27 of the main routine.

First, whether the stapling mode is designated as the operation mode or not is checked at step S251, and whether the stapling and stamping mode is designated or not is checked at step S252. If the stapling mode is designated, after it is confirmed at step S254 that the copying machine 1 is not in operation, it is checked at step S225 whether the alignment flag is at "1" or not. On the other hand, if the stapling and stamping mode is designated, the ejection flag is set at "1" at step S253, and the processing orderly goes to steps S254 and S255. The ejection flag is kept at "1" during the stamping operation for the purpose of delaying the ejection of the sheets from the stapling tray 150 so that the stamping operation is executed after the stapling operation.

The alignment flag is set at "1" when one set of copying paper is finished to be aligned in the alignment subroutine. So, if the alignment flag is at "1" it is checked at step S256 whether a timer B flag is at "0" or not. If it is at "0", at step S257, a timer (B) is started and the timer B flag is set at "1". The timer (B) determines the timing at which the stapler 190 is driven.

Next, after it is confirmed at step S258 that the timer (B) counts up the time, it is checked at step S259 whether the staple flag is at "0" or not. If it is at "0", the staple motor is turned on at step S260 in order to actuate the stapler 190 to staple the sheets, and simultaneously the staple flag is set at "1".

Next, it is checked at step S261 the ejection flag is at "1" or not. If it is at "1", the processing returns to the main routine to execute the stamping operation. If the ejection flag is at "0", since only the stapling operation is necessary, it is checked at step S262 whether a timer C flag is at "0" or not. If it is at "0", at step S263, the ejection solenoid is turned on, and the paddle wheel motor is turned on. Thereby, the stopper 160 retreats to open the bottom of the stapling tray 150, and the stapled sheets are ejected into the stack box 220. In this moment, the stapled sheets are ejected from the stapling tray 150 correctly and smoothly by the rotation of the paddle wheel 180. Further, at step S263, the timer C flag is set at "1", and a timer (C) is started. The timer (C) determines the timing at which the stapling tray 150 returns to its initial state in the stapling mode.

When it is confirmed at step S264 that the timer (C) counts up the time, at step S265, the ejection solenoid is turned off, the timer B flag and the timer C flag are reset at "0", the alignment flag and the staple flag is reset at "0", and the paddle wheel motor is turned off. Thus and so, one cycle of stapling operation is completed.

Figure 26:
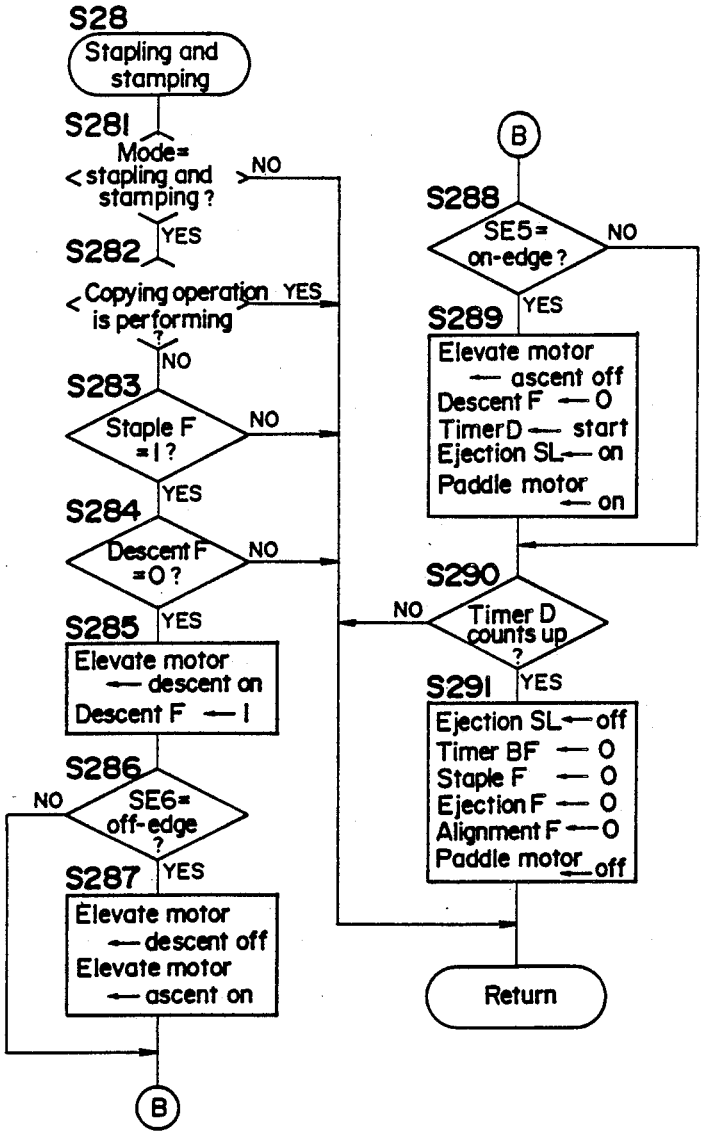
FIG. 26 is a flow chart showing a subroutine for the stapling and stamping operation.

FIG. 26 shows a subroutine for the operation in the stapling and stamping mode to be executed at step S28 of the main routine.

This subroutine is executed continuously after the ejection flag is judged to be at "1" at step S261 of the above-described stapling mode subroutine. Consequently when this subroutine is to be executed, the sheets in the stapling tray 150 has been already stapled, and the staple flag is kept at "1".